US006802265B1

(12) United States Patent
Dodson et al.

(10) Patent No.: US 6,802,265 B1
(45) Date of Patent: Oct. 12, 2004

(54) UNIVERSAL TABLE COMPRISING AN ORGANIZER BASE WITH DETACHABLE POCKETS; CONNECTING, SUPPORTING, AND ADJUSTMENT MECHANISMS; AND A MULTI-POSITIONAL TABLE

(76) Inventors: Robert Leroy Dodson, PMB 869 713 W. Spruce, Deming, NM (US) 88030; Carol Ann Dodson, PMB 869 713 W. Spruce, Deming, NM (US) 88030

( * ) Notice: Subject to any disclaimer, the term of this patent is extended or adjusted under 35 U.S.C. 154(b) by 0 days.

(21) Appl. No.: 10/208,619

(22) Filed: Jul. 31, 2002

(51) Int. Cl.[7] ..... A47B 37/00
(52) U.S. Cl. ..... 108/50.11; 108/1; 108/50.12
(58) Field of Search ..... 108/50.11–50.12, 108/42, 49, 50.02; 297/144, 135, 170, 172, 423.39, 423.4, 423.1

(56) References Cited

U.S. PATENT DOCUMENTS

| | | | | | |
|---|---|---|---|---|---|
| 2,535,112 | A | * | 12/1950 | Woody | 108/49 |
| 3,543,312 | A | * | 12/1970 | Pofferi | 108/49 |
| 4,512,607 | A | * | 4/1985 | Rapp | 297/153 |
| 4,524,484 | A | | 6/1985 | Graham | |
| 4,744,690 | A | | 5/1988 | Hsieh | |
| 5,129,702 | A | | 7/1992 | Ervin | |
| 5,144,898 | A | | 9/1992 | Posly | |
| 5,293,825 | A | | 3/1994 | Cauffiel | |
| 5,479,865 | A | | 1/1996 | Cauffiel | |
| 5,503,086 | A | | 4/1996 | Hoffman | |
| 5,549,052 | A | | 8/1996 | Hoffman | |
| 5,606,917 | A | | 3/1997 | Cauffiel | |
| 5,606,918 | A | | 3/1997 | Cauffiel | |
| 5,615,620 | A | * | 4/1997 | Owen | 108/45 |
| 5,839,780 | A | | 11/1998 | Cauffiel | |
| 5,967,599 | A | | 10/1999 | Cauffiel | |
| 6,516,729 | B1 | * | 2/2003 | Dodson et al. | 108/50.11 |

FOREIGN PATENT DOCUMENTS

| | | | |
|---|---|---|---|
| GB | 2113086 | * | 8/1983 |

* cited by examiner

*Primary Examiner*—Jose V. Chen

(57) ABSTRACT

A Universal Table with an organizational base, table, connecting, holding, supporting, and adjusting mechanisms for use beside any seating, reclining, or bed-type furniture is disclosed. The base provides ballast for the table and other attachments, and provides areas for storing desired supplies. The connecting devices and mechanisms allow positioning of a table and other attachments in relation to the base and to the seating/reclining/laying furniture. The table has the following adjustment features: it slides from left to right; it is adjustable closer or further away from a user; it is tiltable, past perpendicular; it swivels and rotates about its vertical support; and it is adjustable in height. Accessories can be added to the Universal Table at the base, table, and to the upright supports.

11 Claims, 21 Drawing Sheets

UNIVERSAL TABLE COMPRISING AN ORGANIZER BASE WITH DETACHABLE POCKETS; CONNECTING, SUPPORTING, AND ADJUSTMENT MECHANISMS; AND A MULTI-POSITIONAL TABLE

CROSS-REFERENCE TO RELATED APPLICATIONS

Disclosure Document filed Mar. 8, 1999, U.S. Pat. No. 452,653

Utility patent application filed Jan. 11, 2001, Ser. No. 09/759,572;

Provisional Patent Application filed Jul. 30, 2001, Ser. No. 60/308,391

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates to the field of devices that support objects adjacent to a person in a seated, reclining, or laying position, i.e. convenience tables. More particularly, the present invention relates to convenience tables that are multi-functional, freestanding, adjustable, and attractive.

The field of convenience tables is dominated by devices that are designed for a single purpose or for a very narrow range of applications. Examples of such tables are end tables, coffee tables, book holders, foldaway tables that attach to furniture, tables for use with hospital beds, and craft tables, snack and TV trays. Many of these tables are lightweight and easily tipped.

One drawback of the support surfaces provided by end tables is the inconvenient location of the table surface relative to an occupant in the seating unit. The table surface of an end table is placed beside rather than directly in front of a seated occupant. The occupant must twist to retrieve a plate or glass from the end table, or twist to eat from the plate placed on the end table.

Use of coffee tables also requires leaning forward. Even those tables that have mechanisms to move a portion of the coffee table into closer proximity to the user require leaning forward while raising or lowering the moveable portion.

A similar problem exists with the use of snack trays, also called TV trays. The tray legs prevent the user to position the tray close enough to use, for eating, writing, or other activities, without having to lean over. This puts stress on the user's back, causing pain for many people. In order to move the tray to rise from the seat, the user must lift the tray up and forward or twist to the side to re-position it out of the way. Again, this is difficult for many people. Use of a TV tray is also difficult, if not impossible, when seated in a recliner with an extended footrest, or in a bed.

Hospital bed trays have an extended support leg that is often too high in profile for most beds in homes; does not work with a waterbed at all; and interferes with placement in front of or beside most chairs, especially those with extended footrests.

Book holders are not designed to be supportive of dishes, games, and other objects in a level position.

Craft tables are usually designed with pre-determined bulky cavities that are often not adaptable for other uses.

Foldaway tables must be cleared of all items before being removed from in front of the user. This may require the assistance of a second person, therefore is not an option for many people.

Many of these tables do not provide storage areas for supplies needed for activities, such as magazines or papers, remote controls, writing, art, or eating utensils, an ice bucket, or plants. They also do not provide for the attachment of additional accessories, such as a magnifying glass, a light, an electronic game holder, a phone holder, an umbrella, or fishing rod holder.

Many of these devices are largely utilitarian in design and lack a pleasing appearance. Further, most of these devices are designed for use exclusively inside a living space or business, or are designed exclusively for outdoor use.

An adjustable table as shown in L. Posly, U.S. Pat. No. 5,144,898 (expired), has a T-shaped base as ballast with an extension leg that does not fit under or in front of many chairs (rockers, recliners), prohibiting placement of the table top in proper relationship to the user. This table is to be 'mountable' to chairs. The T-shaped base has no other purpose than support.

A cabinet and table assembly for use with seating apparatus shown in F. Cauffiel, U.S. Pat. No. 5,967,599 & 5,839,780, and table with movable top surface shown in S. Hoffman, U.S. Pat. No. 5,503,086 & 5,549,052, each provide a horizontally disposed table surface in front or beside the user, but no provision is allowed for a tiltable surface for reading or writing.

Tables with base plates shown in F. Cauffiel, U.S. Pat. No. 5,606,917, 5,606,918, 5,479,865, and 5,293,825, will be supported only when the base plate is placed under a support of a chair leg (or wheel) and thus will not stand alone. These tables rely upon the weight of a seating apparatus for stabilization and supporting means. These tables will not adapt to use with rocking chairs, lawn chairs, nor chairs on rollers or castors.

A table attached to a chair is shown in D. Ervin U.S. Pat. No. 5,129,702 with a mechanism that is mounted to the bottom frame of the chair, with the table to be stored under the chair, then pulled out and pivoted to a vertical position for use. This table is limited to the chair to which it is bolted, and the mechanism can not be transferred to all designs of chairs, i.e. rockers, platform rockers, four-legged chairs, lawn chairs, wheelchairs, chairs on rollers or castors, or beds. There are only two basic positions for the table: a fold-away position and a vertically extending position in front of the chair. The table support leg must be re-positioned from horizontal to vertical for use. Thus it is not designed to be in a ready-to-use position.

Thus, there exists the need for an attractive Universal Table, that stands alone, that is positional on the left or right side of a multiplicity of seats, reclining, or bed-type furniture, that provides a storage area, that adjusts easily for height and position, that has a movable table top area which is easily adjusted to a level position, tilted position, shifted right to left, located closer or further from the user, and swivels from in front of the user to the side for ease of movement from a seated, reclining, or laying position, without lifting or removing anything on the surface of the table.

SUMMARY OF THE INVENTION

The present invention is a Universal Table as a freestanding, adjustable convenience system with a filly adjustable table surface, provides storage areas; that stands alone with an acceptable degree of stability; is usable on the left or right side of any piece of furniture designed for sitting, reclining, or laying; has adjustment mechanisms to change configurations and be re-secured with a minimum of effort; is designed so that other attachments may be easily added; is attractive as an added piece of furniture; and is suited for use both indoors and outdoors.

The first object of the present invention is to provide a convenience system incorporating a base providing a storage area and a usable table surface for use alone or beside any piece of furniture designed for sitting, reclining, or laying down.

It is also an object of the present invention to provide a convenience system that is freestanding, without being attached to a floor, wall, or any other piece of furniture or object, with an acceptable degree of stability.

Another object of the present invention is to provide a convenience system, with a usable table surface in both the conventional lateral position of an end table and a position more accessible for an occupant of a seating unit, and to do so without sacrificing the usual functions provided by end tables.

It is an additional object of the present invention to provide a convenience system that is adjustable as to the position of the table surface in reference to the storage unit, adjustable in height, adjustable in distance from the user, and placement on either the left-or-right-hand side.

It is also an object of the present invention to provide a convenience system that has a level table surface.

It is an additional object of the present invention to provide a convenience system that has a table surface that is easily tilted to varying degrees, and even beyond perpendicular.

It is a further object of the present invention to provide a convenience system that has a table surface that is horizontally adjustable, being slideably adjustable from side to side.

It is also an object of the present invention to provide a convenience system that has a table surface that is horizontally adjustable, in proximity to user, either closer or further away.

It is an additional object of the present invention to provide a convenience system that has a table surface with a pivotal support means to allow the user to easily swing the table surface out of the way, with just a light touch, when moving to and from a seated, reclining, or laying position.

It is also an object of the present invention to provide a convenience system that will provide storage of desired objects.

It is also an object of the present invention to provide a convenience system that is adaptable for additional attachments and other accessories. Some of the accessories for the table top can include, but are not limited to, book holders, page holders, drawers, trays for craft supplies, wrist rests, cup holders, lights or fans, electronic equipment holders, pencil holders, sunshades or table extensions. Other accessories that can be added to the convenience system base are a removable liner, a variety of lids, self-watering planter, domed plant cover, plant trellis, heaters for plants, wire racks, night light, misting system, or wheels. Attachments or accessories that can be attached to the Universal Table are an umbrella, lights, a fishing pole holder, fans, cup holders, a mirror, or a magnifying glass. Many other items will also adapt to this Universal Table convenience system as an attachment or accessory.

It is also an object of the present invention to provide a convenience system that will stand alone for use as an easel, with the system base providing a storage area for art supplies or a seat with a lid on the base cavity.

It is also an object of the present invention to provide a convenience system that will have adjustment mechanisms functioning with a minimum of effort from the user.

It is also an object of the present invention to provide a convenience system that is attractive as an added piece of furniture and does not have to be stored when not in immediate use.

It is also a further object of the present invention to provide a convenience system that is suited for use both indoors and outdoors.

It is also a further object of the present invention to provide a convenience system having removable pockets on the outside of the base, with additional convenient spaces to place items.

REFERENCE NUMERALS IN DRAWINGS

Figure 1:
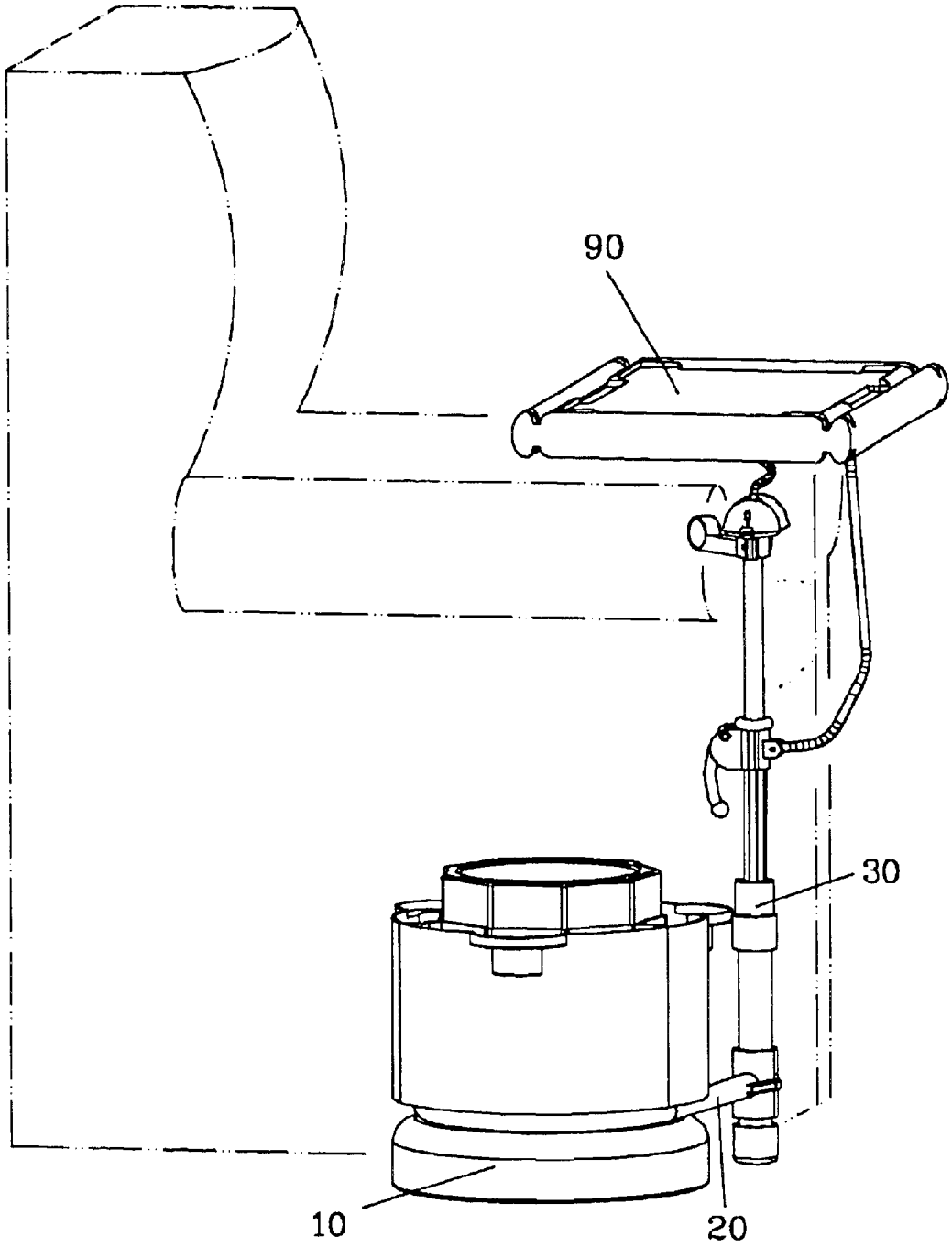
FIG. 1 shows an isometric assembled view of the Universal Table in relation to a phantom chair.

10 base
11 tower section
12 inner concave cavity
13 outside concave surfaces
14 points
15 pockets
16 projection
17 vertical channel strips
18 inner cavity
19 projection strips
20 extension apparatus mechanism
21 hook-shaped extension section
23 extension support section
25 clamping sleeve
27 latching mechanism
30 table support assembly
40 telescoping vertical mechanism
41 telescoping upright
43 non-rotating telescoping upright
43*a* hole
43*b* telescoping holes
44 screw
45 round upright
45*a* hole
46 screw
47 hollow upright
47*a* hole
48 grooved indention
49 removable tip
50 table level/tilt adjustment mechanism
51 slide body
51*a* holed bracket
51*b* holed bracket
52 bolt
53 handle
53*a* holed cam
54 nut
55 brake
56 bolt
57 table support/tilt arm
57*a* circular support segment
57*b* configured bar
57*c* hole in configured bar
58 nut
60 table horizontal adjustment mechanism
61 clamp
61*a* clamp segment
61*b* clamp segment
63 table support/rotation arm
63*a* circular support segment
63*b* configured bar
65 clamshell
65*a* clamshell segment
65*b* clamshell segment
67 guide
67*a* multi-cornered cutout area
67*b* extension arm
67*d* guide pin
67*e* guide hole
67*f* guide hole
68 domed cover
68*a* receiver
68*b* arm hole
69 lever
69*a* lever short leg
69*b* lever pin
69*c* lever hole
69*d* lever hole
71*a* wing of clamp 61 with pintile
71*b* wing of clamp 61
71*c* wing of clamp 61
71*d* wing of clamp 61
73*a* hole
73*b* hole
73*c* hole
73*d* hole
75 bolts
77 nuts
79 pintile of clamp 61
79*a* pintile latching device means on pintile 79
82 hinge means
82*a* holed loop extension
82*b* holed loop extension
82*c* holed loop extension
83 circular cutout area
84*a* brake shoe
84*b* brake shoe
84*c* brake recessed cavity
84*d* brake recessed cavity
84*e* brake adjusting screw
84*f* brake adjusting screw
84*g* brake screw hole
84*h* brake screw hole
85 notched cutout area
86*a* abutting area
86*b* abutting area
86*c* abutting area
87 spring
87*a* spring hole
87*b* spring hole
87*c* spring pin
87*d* spring pin
87*c* spring pinhole
87*f* spring pinhole
87*g* spring hook
87*h* spring hook
88 guide flange stop
89 guide flange stop
90 table
91 table support platform
91*a* internal circular channel
91*b* internal circular channel
91*c* platform slot
91*d* platform slot
92*a* cam latching mechanism
92*b* cam latching mechanism
92*c* screw section
92*d* screw section
92*e* lever
92*f* lever
92*g* nut
92*h* nut
92*i* lever (in open position)
93 rounded edge of table 90
94 insert wall
95 grooves between top side and edge of table 90
95*a* grooves between underneath side and edge of table 90
96 indention
97*a* table insert
97*b* table insert
97*c* table insert
97*d* table insert
98 center of table top side

98*a* recessed area
99 notches for holding table insert
110 extended base section
111 entrapment ring
113 spacer
115 holed tabs
117 bolts
119 nuts
120 hollow chamber hole
121 fill plug
123 cavity in base, underneath
125 receptor holes
127 lid
130 wheel assembly mechanism
131 wheel
133 shaft
135 bearings
137 hubs
140 vertical adjustment mechanism
145 cavity in round upright 45
150 handle assembly mechanism
151 telescoping extension
152 telescoping extension
153 hinge assembly mechanism
153*a* hinge section
153*b* hinge section
153*c* cam lever
153*d* handle pintile
153*e* handle pintile
153*f* handle latching device
153*g* springs
153*h* shaft
153*i* pin
153*j* segment
153*k* segment
153*m* segment
153*n* cavity
155 linkage
157 holes
161*a* adjusting mechanism
161*b* adjusting mechanism
161*c* adjusting mechanism
200 umbrella accessory shown in phantom
210 unattached chair shown in phantom
220 auxiliary extension apparatus mechanism
221 auxiliary hook-shaped extension section
223 auxiliary extension support section
225 auxiliary extension telescoping upright
227 auxiliary telescoping upright
229 auxiliary fulcrum upright
320 supplementary extension apparatus mechanism
321 supplementary hook-shaped extension section
323 supplementary extension support section
325 supplementary extension telescoping upright
327 supplementary telescoping upright

DESCRIPTION OF THE INVENTION

The invention, an article of furniture for holding items, hereinafter referred to as a Universal Table, is comprised of a base, an extension apparatus mechanism, a table support assembly mechanism and a table. The design provides an acceptable degree of stability and allows the invention to be used alone or to the left or right near any seat, and is especially adaptable beside reclining chairs and beds.

FIG. 1 shows an assembled view in isometric form of the Universal Table with a chair in phantom as a reference. FIG. 1 further illustrates the base 10 of the Universal Table positioned on the right side of the chair and the table 90, as it would be in front of a person in a seated position.

The base 10, setting on a floor, has cavities that will hold items. Base 10 can be manufactured from a number of materials, but must have sufficient mass and weight to provide a low center of gravity, ballast, and stability for the rest of the invention and attached accessories.

An extension apparatus mechanism 20 hooks onto base 10.

The table 90 is supported with table support assembly 30, attached to an extension apparatus mechanism 20.

Figure 2A:
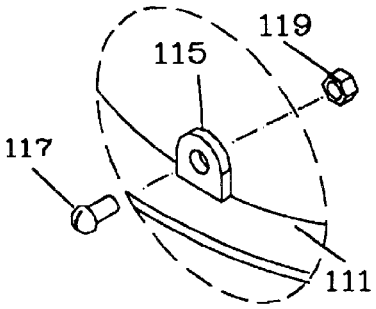
FIG. 2 is an isometric exploded view of the parts comprising the base, extension apparatus mechanism, entrapment ring, pockets, with two detailed views of cutaway portions of the entrapment ring.
Figure 2:
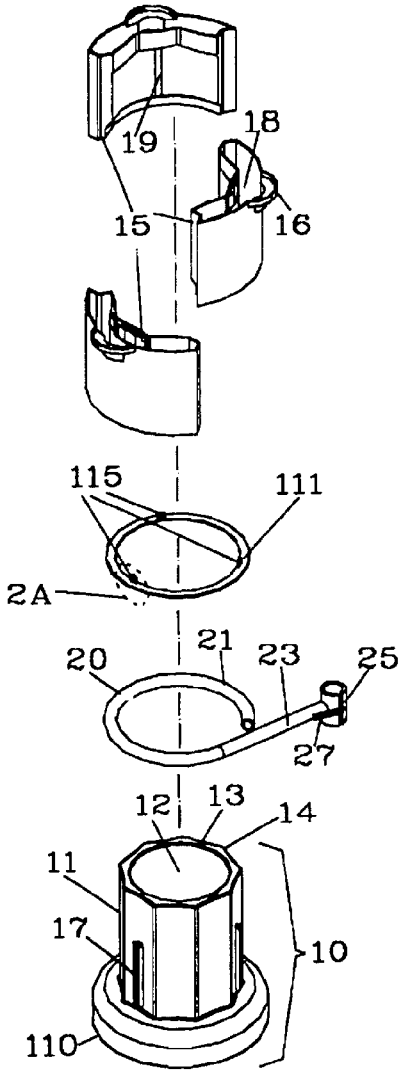

In FIG. 2, base 10 is comprised of a tower section 11, an entrapment ring 111, and an extended base section 110.

Tower section 11 has an inner concave cavity 12. The tower section 11 has concave surfaces 13 and points 14 about the tower sections outside diameter.

An extension apparatus mechanism 20 is comprised of a hook-shaped section 21, an extension support section 23 with a clamping sleeve 25 with a latching mechanism 27.

The hook-shaped section 21 of extension apparatus mechanism 20 slides over and around the tower section 11, until it comes to bear on the extended base section 110, and is indexed into place by the points 14.

The indexing points 14 provide a minimal amount of resistance and less friction as the hookshaped section 21 rotates around the axis of tower section 11.

An entrapment ring 111 is comprised of a circular piece with holed tabs 115 for receiving bolts 117 and nuts 119, as shown in Detail A.

The entrapment ring 111 is positioned on the tower section 11 to hold the hook-shaped section 21 in place, without restricting the independent rotation of the hook-shaped section 21 about the axis of base 10.

The entrapment ring 111 is secured to the vertical channel strip 17 with bolts 117 and nuts 119, as shown in Detail B. Nuts 119 are placed inside strips 17, and securely tightened with bolts 117 after entrapment ring 111 is in position on tower section 11.

The entrapment ring 111 is a non-rotating bearing surface, upon which the pockets 15 will rest.

Pockets 15 are shaped to index into the concave surfaces 13 around the tower section 11, and provide an inner cavity 18. The outer rim of pockets 15 has a projection 16.

On the tower section side of pockets 15 are projection strips 19 to position the pocket 15 onto vertical channel strips 17 on the tower outer concave sections, above the entrapment ring 111.

Pockets 15 are located on tower section 11 providing additional areas to place items and to increase the ballast aspect of base 10.

Figure 3:
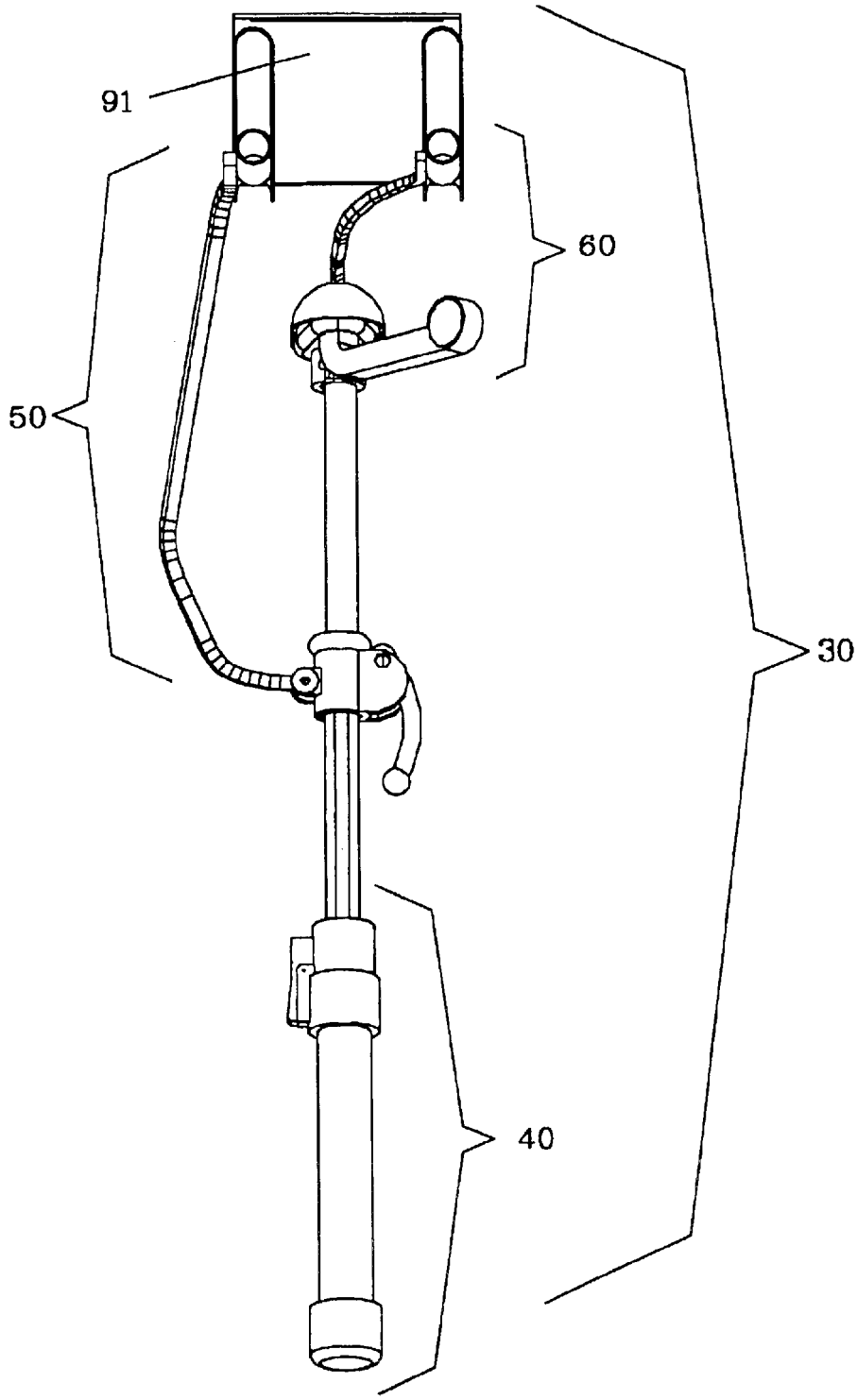
FIG. 3 is an isometric view of the table support assembly.

In FIG. 3, table support assembly 30 is comprised of a telescoping vertical mechanism 40, a table level/tilt adjustment mechanism 50, a table horizontal adjustment mechanism 60, and a table support platform 91.

Figures 4, 4A, 5:
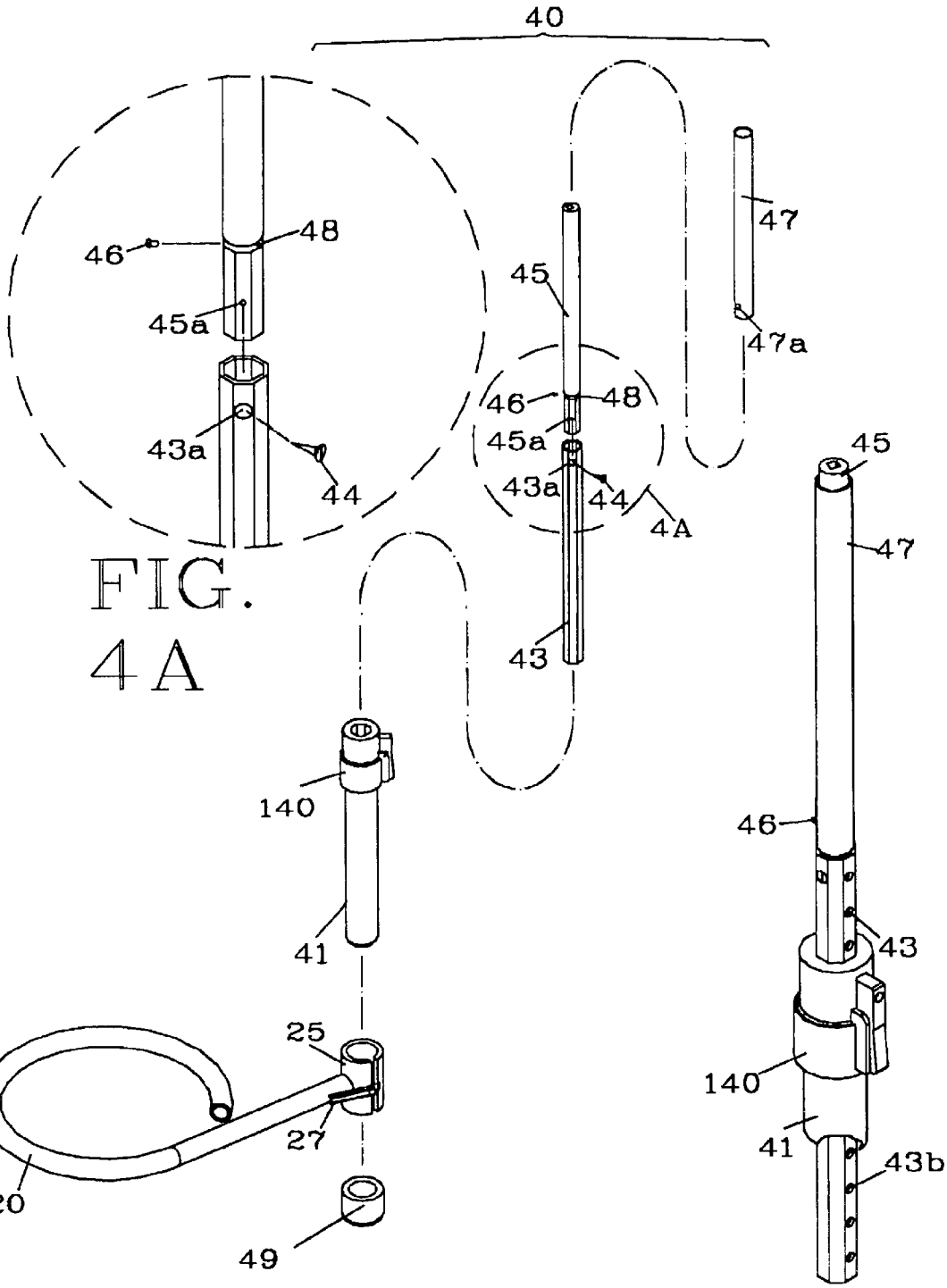
FIG. 4 is an exploded view of extension apparatus mechanism and the telescoping vertical mechanism of the table support assembly. is an assembly cutaway view of part of the telescoping vertical mechanism of the table support assembly.

In FIG. 4, telescoping vertical mechanism 40 is comprised of a telescoping upright 41 removably attached to the clamping sleeve 25 of extension apparatus mechanism 20, a vertical adjustment mechanism 140, a non-rotating telescoping upright 43 affixed to a round upright 45, and a hollow upright 47.

Clamping sleeve 25 has a latching mechanism 27 that when open will allow for insertion of upright 41 through clamping sleeve 25. An optional removable tip 49 is placed on the bottom of telescoping upright 41. The latching mechanism 27 is closed to secure upright 41. A fulcrum point is created between the base and the table as the upright 41, or tip 49 attached to upright 41, rests on the floor.

A vertical adjustment mechanism 140 is affixed to the top of upright 41. Vertical adjustment mechanism 140 is a standard spring-loaded device of public domain. To achieve vertical adjustment, the spring collapses, releasing a pin inserted into a selected hole in upright 43. Once a desired height is achieved, the pin engages in another pinhole.

Screw 44 is inserted through hole 43*a* of upright 43 and into hole 45*a* of upright 45, locking uprights 43 and 45 together to perform as one solid piece.

Screw 46 is affixed to upright 47 through hole 47*a* and lines up with a grooved indention 48 that encircles upright 45 to allow upright 47 to rotate around the common axis of uprights 45 and 47 for horizontal positioning.

The sectional view FIG. 5 shows uprights 43/45 placed through the vertical adjustment mechanism 140 that is affixed to the top of upright 41 shown as a cut-away portion. Also shown in upright 43 are the telescoping holes 43*b*. Upright 47 is shown affixed to uprights 43/45 by screw 46 positioned through the hole in upright 47 and into the grooved indention of upright 45. Uprights 43/45 extend beyond the full height of upright 47.

Figure 6:
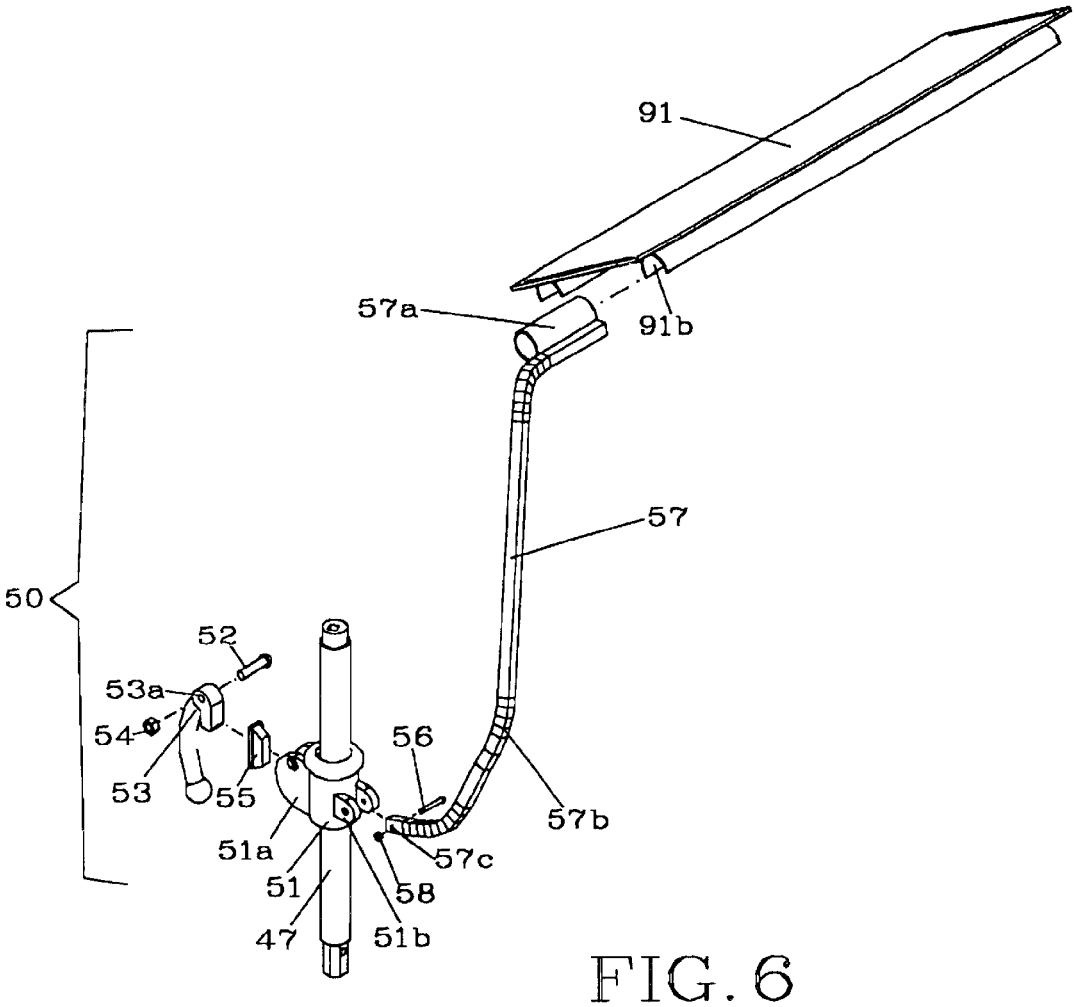
FIG. 6 is a view of telescoping table level/tilt adjustment mechanism of table support assembly.

In FIG. 6, table level/tilt adjustment mechanism 50 is comprised of a slide body 51, a handle 53, a brake 55, and a table support/tilt arm 57.

Slide body 51 has two pair of holed brackets 51*a* and 51*b*. One end of handle 53 has a holed cam 53*a*. The handle 53 holds brake 55 into position in a slot between the holed brackets 51*a*. The handle 53 is held in the brackets 51*a* by bolt 52 and nut 54. The slide body 51 is slideably attached about upright 47.

Table support/tilt arm 57 is comprised of a circular support segment 57*a* attached to a configured bar 57*b*. Table support/tilt arm 57 is pivotally held in brackets 51*b* with bolt 56 and nut 58 through hole 57*c* of configured bar 57*b*. The circular support segment 57*a* is entrapped into the channel member 91*b* of table support platform 91.

The handle 53 pivots about the axis of bolt 52 releasing the brake 55 with a cam action to allow the table level/tilt adjustment mechanism 50 to slide vertically on upright 47 that drafts table support/tilt arm 57 which levels or tilts table support platform 91.

Figure 7:
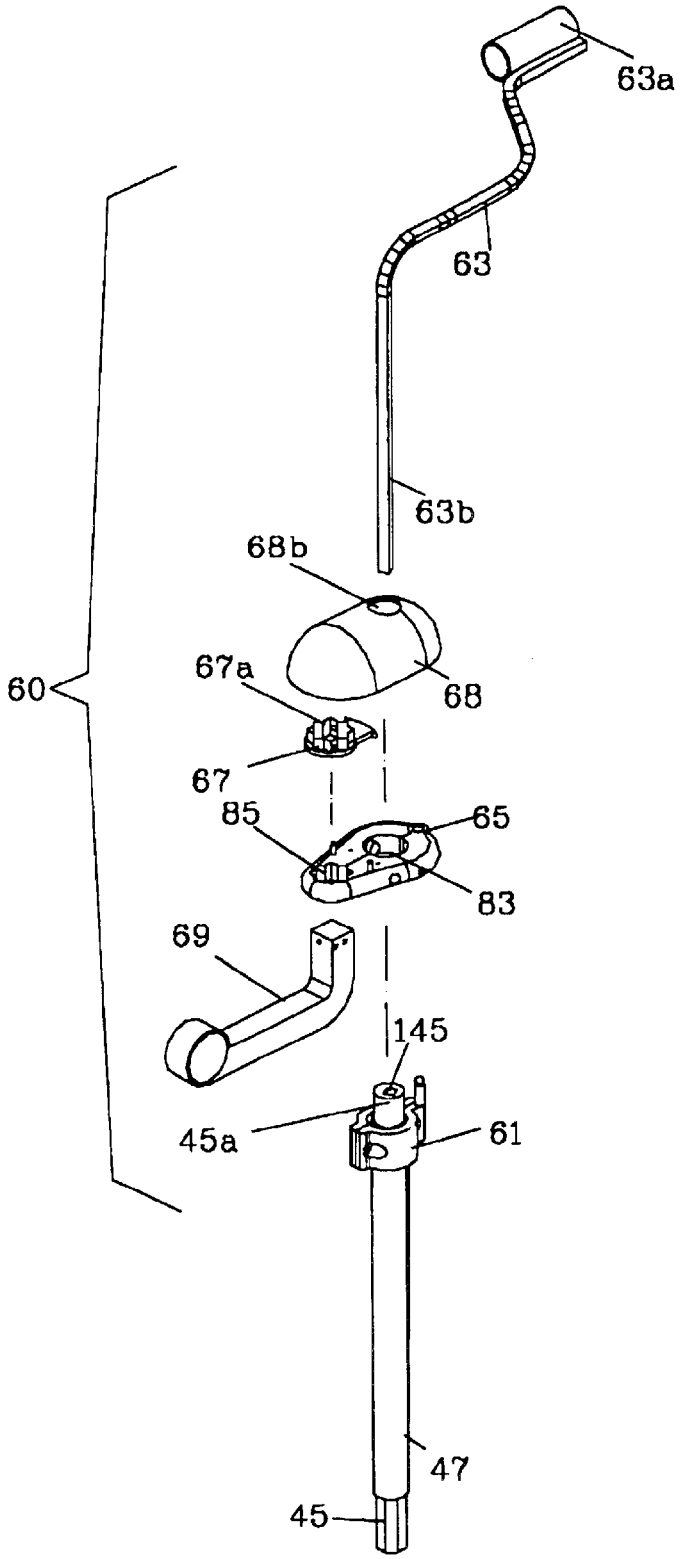
FIG. 7 is a view of the table horizontal adjustment mechanism of the table support assembly.

FIG. 7 shows the table horizontal adjustment support mechanism 60 comprised of clamp 61, table support/rotation arm 63, clamshell 65, guide 67, domed cover 68, and lever 69. Clamp 61 is configured to fit around, and is fixedly secured to the top of hollow upright 47. Upright 45 extends through and above upright 47. The upright portion 45*a* extends through a circular cutout area 83 of clamshell 65. Clamshell 65 rests on clamp 61.

Brake shoes, placed in recessed cavities in clamshell 65, make contact with end upright portion 45*a* of upright 45 of telescoping vertical mechanism to prevent rotation of clamshell 65, clamp 61, and hollow upright 47 about the axis of upright 45.

Lever 69 passes through a notched cutout area 85 of clamshell 65 and multi-cornered cutout area 67*a* of guide 67. Domed cover 68 fits over clamshell 65.

Support arm 63 is comprised of a circular support segment 63*a* attached to a configured bar 63*b*. The bar 63*b* is positioned through arm hole 68*b* of domed cover 68 and vertically inserted into a cavity 145 of upright portion 45*a* of upright 45.

Clamshell 65 has abutting areas between and on either side of the notched area 85 and the circular area 83.

Figure 8:
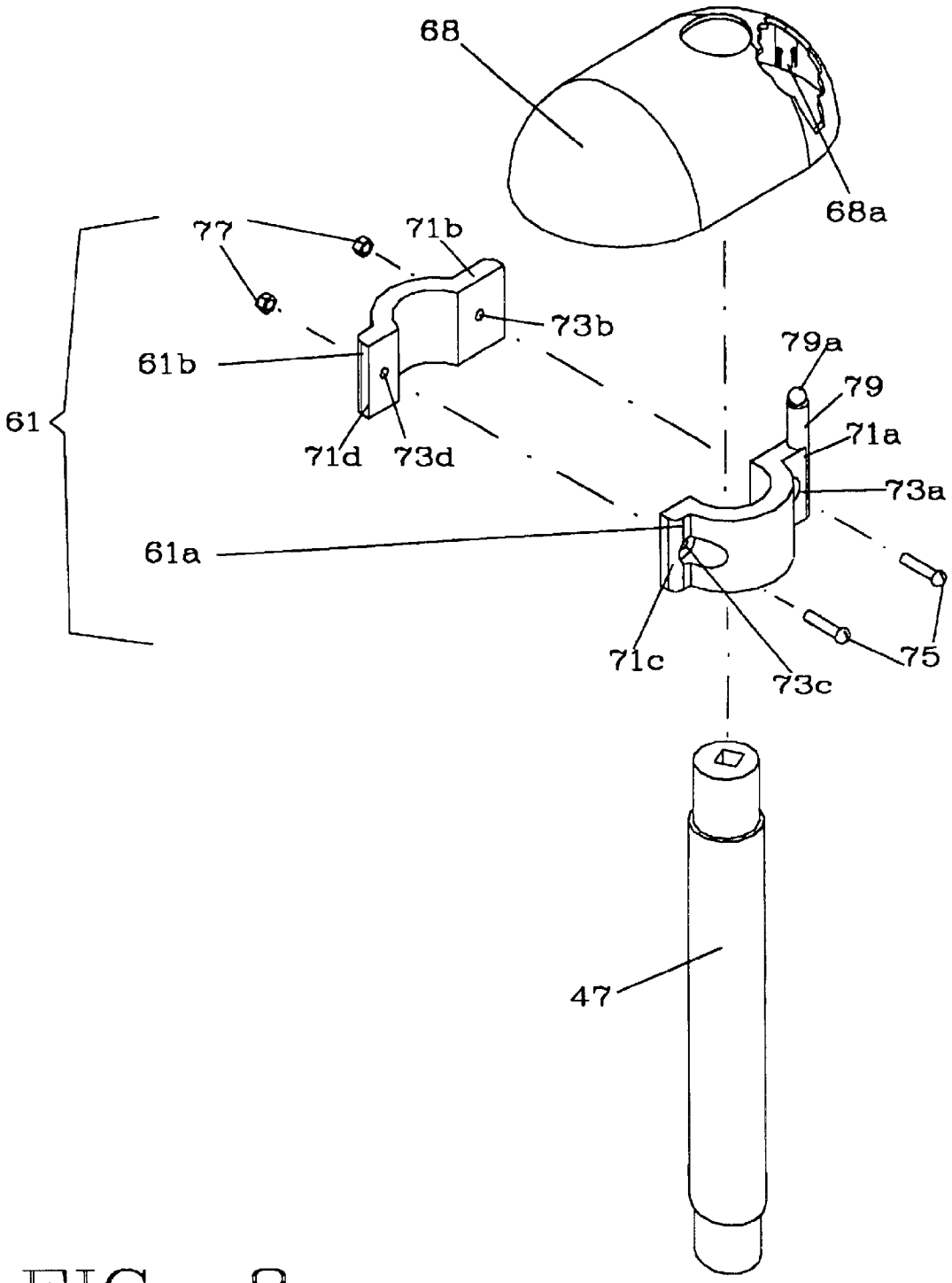
FIG. 8 is an exploded view of the clamp.

Shown in FIG. 8, is each clamp segment 61*a* and 61*b* of clamp 61. The wings 71*a*, 71*b*, 71*c*, 71*d* accommodate holes 73*a*, 73*b*, 73*c*, 73*d* for bolts 75 and nuts 77 to securely fasten clamp 61 to upright 47. A pintile 79 extends above wing 71*a* of clamp segment 61*a* of clamp 61. A pintile latching device 79*a* atop pintile 79 fits into the inside of a receiver 68*a* in the domed cover 68 is shown in the cut-away view.

Figure 9:
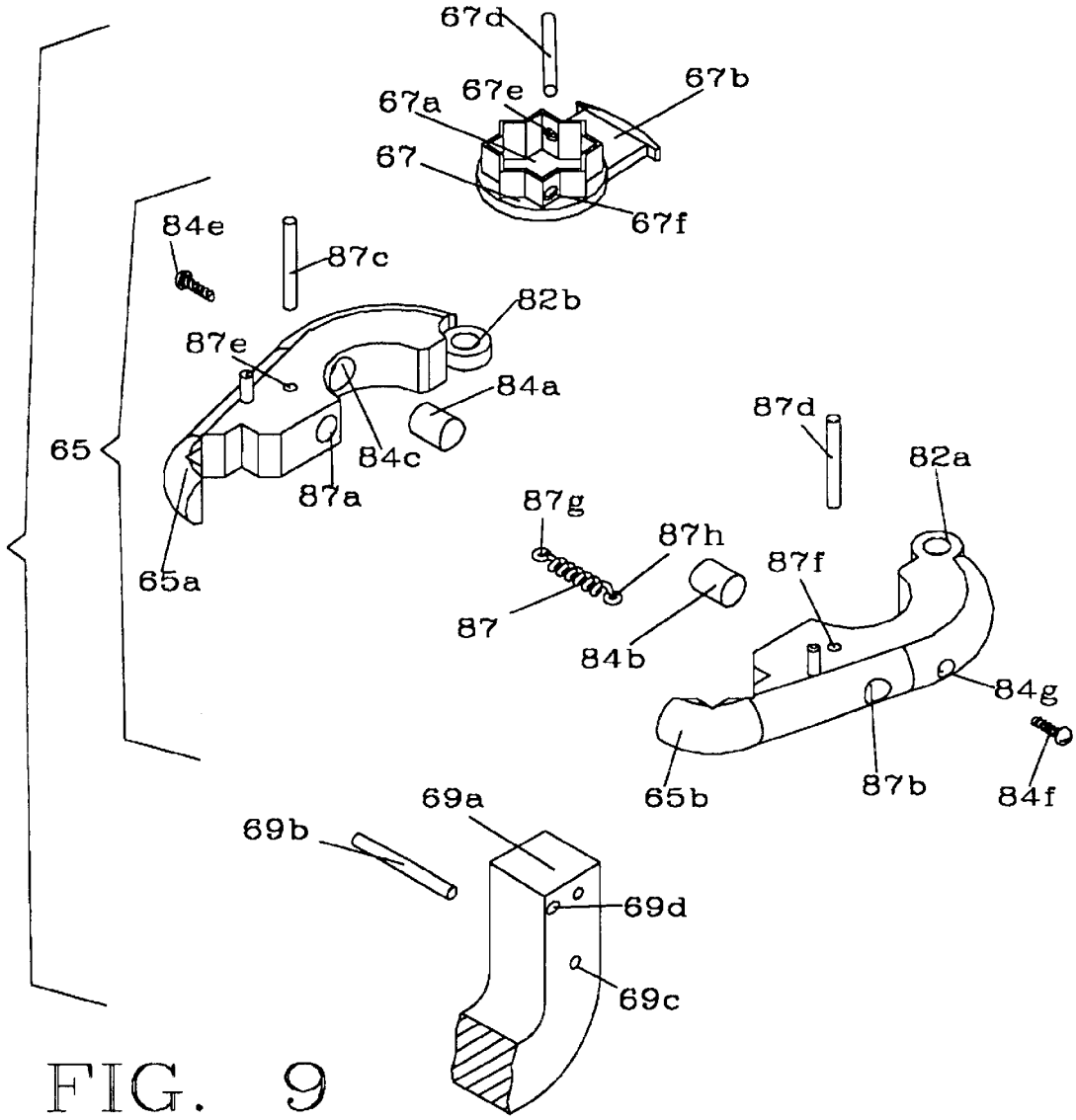
FIG. 9 is a view of the features of the clamshell, lever, and guide of the table horizontal adjustment mechanism.

In the exploded view FIG. 9, clamshell 65 is comprised of clamshell segments 65*a* and 65*b*, a brake mechanism, a spring pulling mechanism, notched area, circular area, and abutting areas.

An abutting area between the circular area and the notched area of each segment of clamshell 65 provides space for a spring 87 to be secured.

In clamshell segment 65*a*, spring 87 is inserted into spring hole 87*a* and held by spring pin 87*c* positioned through pinhole 87*e*, passing through spring hook 87*g* and continuing on into the lower area of clamshell segment 65*a*.

In clamshell segment 65*b*, the other end of spring 87 is inserted into spring hole 87*b* and held by spring pin 87*d* positioned through pinhole 87*f*, passing through spring hook 87*h*, and continuing on into the lower area of clamshell segment 65*b*.

Spring 87 provides constant tension to pull the clamshell segments 65*a* and 65*b* together.

Brake mechanism shoe 84*a* is inserted into a cavity 84*c* of clamshell segment 65*a*. Brake mechanism shoe 84*b* is inserted into a like cavity of clamshell segment 65*b*.

In clamshell 65*b* brake adjusting screw 84*f* is threaded into the screw hole 84*g* until making contact with brake shoe 84*b*. In clamshell segment 65*a* brake adjusting screw 84*e* is threaded into a like screw hole until making contact with brake shoe 84*a*. The braking pressure can be increased and decreased, against the round upright of the telescoping vertical mechanism, by tightening and loosening the brake adjusting screws 84*e* and 84*f*.

The short leg 69*a* of the lever is inserted into the bottom of clamshell 65 through the notched area.

A guide 67 comprising of a multi-cornered cutout area 67*a* and an extension arm 67*b* fits over the short leg 69*a* of the lever coming to bear on the top of the clamshell 65.

Guide pin 67*d* passes through guide hole 67*e*, lever hole 69*d*, and extends through guide hole 67*f*, locking the guide 67 to the lever short leg 69*a*.

A retaining means is used to prevent vertical movement of the lever short leg 69*a* and guide 67, such as a lever pin 69*b* put through lever hole 69*c*, which is just below clamshell 65. Lever pin 69*b* extends beyond both sides of lever short leg 69*a*.

At one end of clamshell segment 65*b* is an offsetting holed ring extension 82*a*, and at the corresponding end of clamshell segment 65*a* is an offsetting holed ring extension 82*b*.

Figure 10:
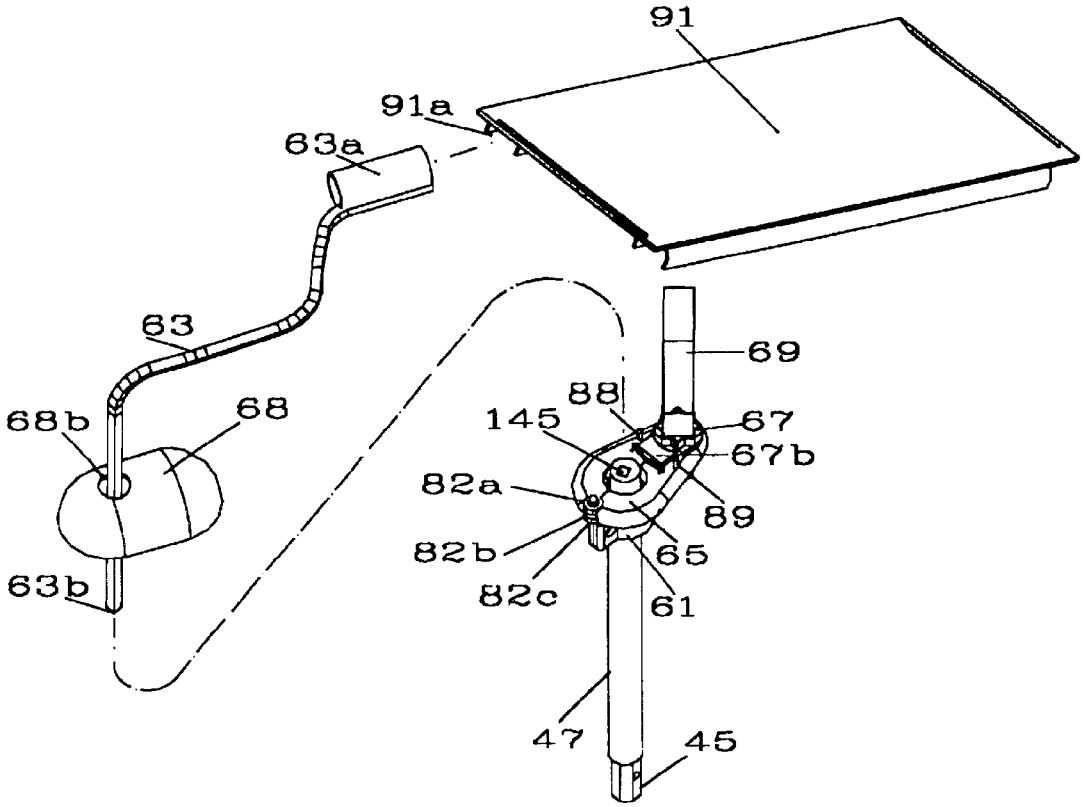
FIG. 10 is a partially exploded, partially assembled view of table horizontal adjustment mechanism.

In FIG. 10 the table horizontal adjustment mechanism is shown with some assembly and some parts exploded.

The assembled clamp 61 is affixed securely to the top of upright 47. Resting on clamp 61 with the circular area encircling upright 45, clamshell 65 is placed over the pintile of clamp 61 by merging holed loop extensions 82*a*, 82*b*, 82*c* to form a stack of loops, creating a hinge means for clamshell 65.

Lever 69 and guide 67 are shown assembled through the notched area of clamshell 65.

Guide flange stops 88 and 89 prevent the guide from moving too far.

In the exploded view, the bar 63*b* of support arm 63 is positioned through arm hole 68*b* of domed cover 68. The bar 63*b* will be vertically inserted into the cavity 145 in the upper end of upright 45.

Domed cover 68 will fasten onto clamp 61 concealing clamshell 65, guide 67, and a portion of the lever short leg 69*a*.

The circular support segment 63*a* of support arm 63 will be entrapped in a channel member 91*b* of table support platform 91.

As the long leg of lever 69 is pushed either left or right, the lever's short leg along with guide 67 will rotate about the axis of the lever's short leg, and continue until guide extension arm 67*b* is stopped by guide stop 88 or guide stop 89.

By pushing the lever 69 left or right, the clamshell 65 is hinged open against the spring tension, releasing the brake pressure exerted against the upright 45, and allowing clamshell 65, clamp 61, upright 47 and any attached components, to rotate about the axis of upright 45.

Once the components have rotated to the desired position, the long leg of lever 69 is released, allowing the spring tension to pull the clamshell sections together, engaging the brakes against upright 45.

Figure 11:
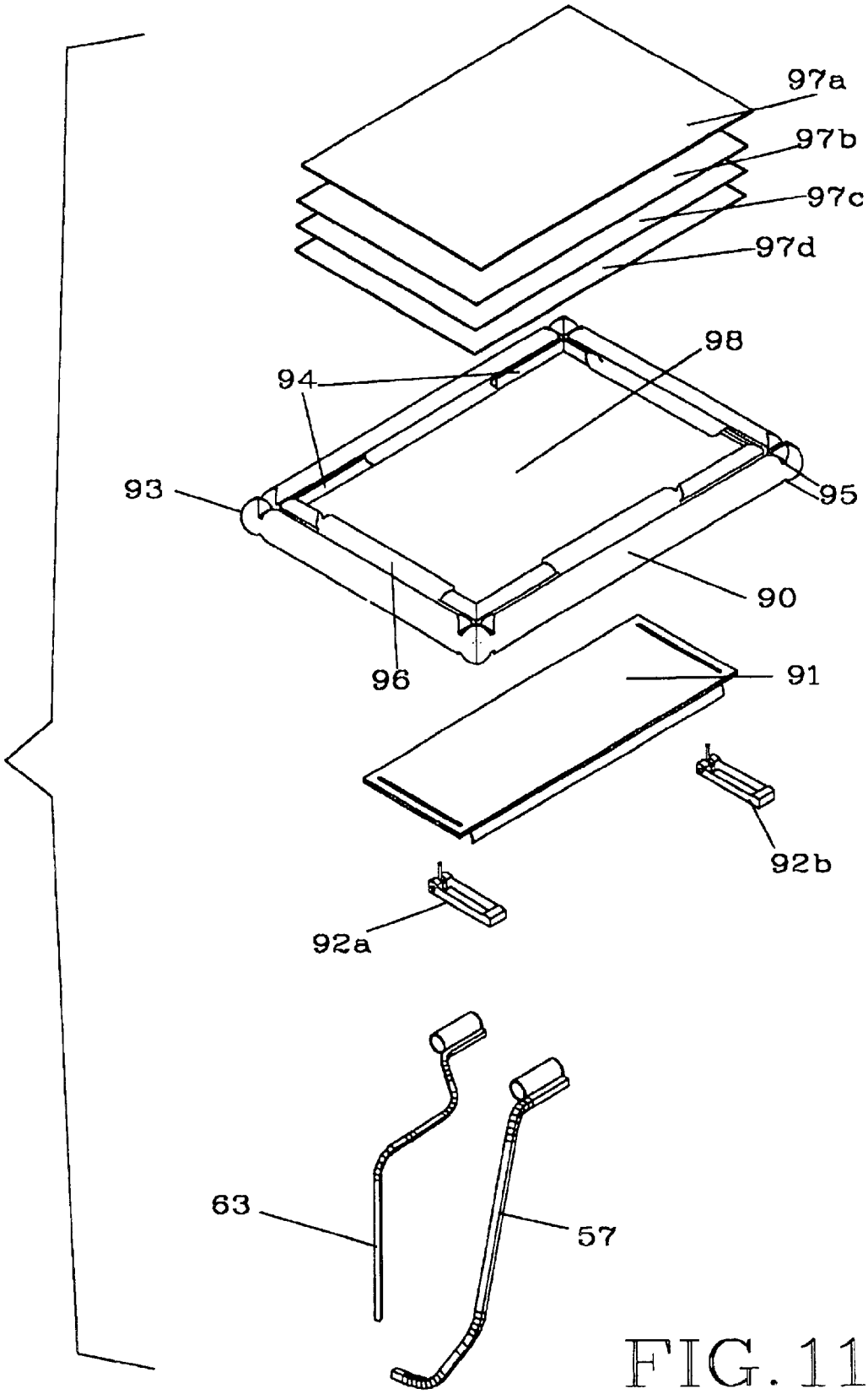
FIG. 11 is an exploded view of the table, table top inserts, table support platform, and table support arms.

Shown in FIG. 11 is the top of table 90 with table inserts 97*a*, 97*b*, 97*c* and 97*d*. The edges 93 encompass table 90. Between the edges 93 and the top center 98 of table 90 are grooves 95. An indention 96 extends inwardly into the top center 98 inside the grooves 95.

The table support platform 91 is positioned between the edges 93 on the underneath side of table 90 and is slideably attached with cam latching mechanism 92*a*/92*b*.

The table support arms 57 and 63 connect the table support platform 91 to the table level/tilt adjustment mechanism and the table horizontal adjustment mechanism.

Figure 12:
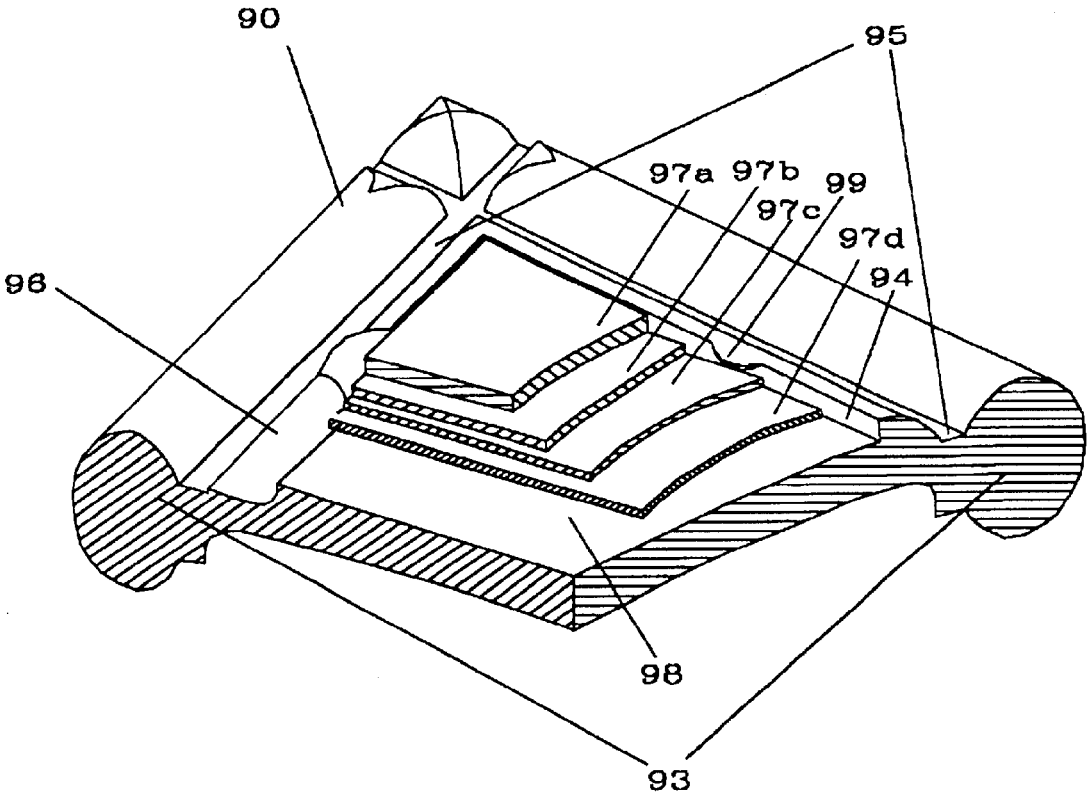
FIG. 12 is a cutaway view of a portion of the table with the stack of inserts.

Shown in FIG. 12, a cutaway portion of the top of table 90, the edges 93 are formed to provide an easy, comfortable grip for a hand, since the shape is similar to the "C" formed when a human brings the thumb and index fingertip toward each other.

The edges 93 are continuous around the outside of table 90, except at the corners. The grooves 95 extend to the outside of table 90 at each corner. This provides a continuous passage for a non-rotating attachment mechanism means of accessory items to be slid onto table 90.

Edges 93 and grooves 95 will allow these accessory items to slide along the edges, but not rotate on the axis of the edges. Such accessories might include, but are not limited to, book straps, a cup holder, a magnifying glass, a document holder, a light, a fan, or a table extension.

The top center 98 of table 90 is an article-supporting surface with an insert wall 94 and an indented area for items such as table inserts 97*a*, 97*b*, 97*c*, and 97*d*. The table inserts 97*a*, 97*b*, 97*c*, and 97*d* are held in place with notches 99 extending from the insert wall 94. These inserts can provide a variety of surfaces for different activities, such as, but not limited to, hard and smooth for writing, non-skid to retain dishware, soft to the touch, or translucent to reveal an entrapped picture, map, or instructions.

Indentions 96 provide an area for the fingertip to get under the table inserts 97*a*, 97*b*, 97*c*, or 97*d* for release from the notches 99, for removal or to change the order of any of table inserts 97*a*, 97*b*, 97*c*, or 97*d*.

Figure 13:
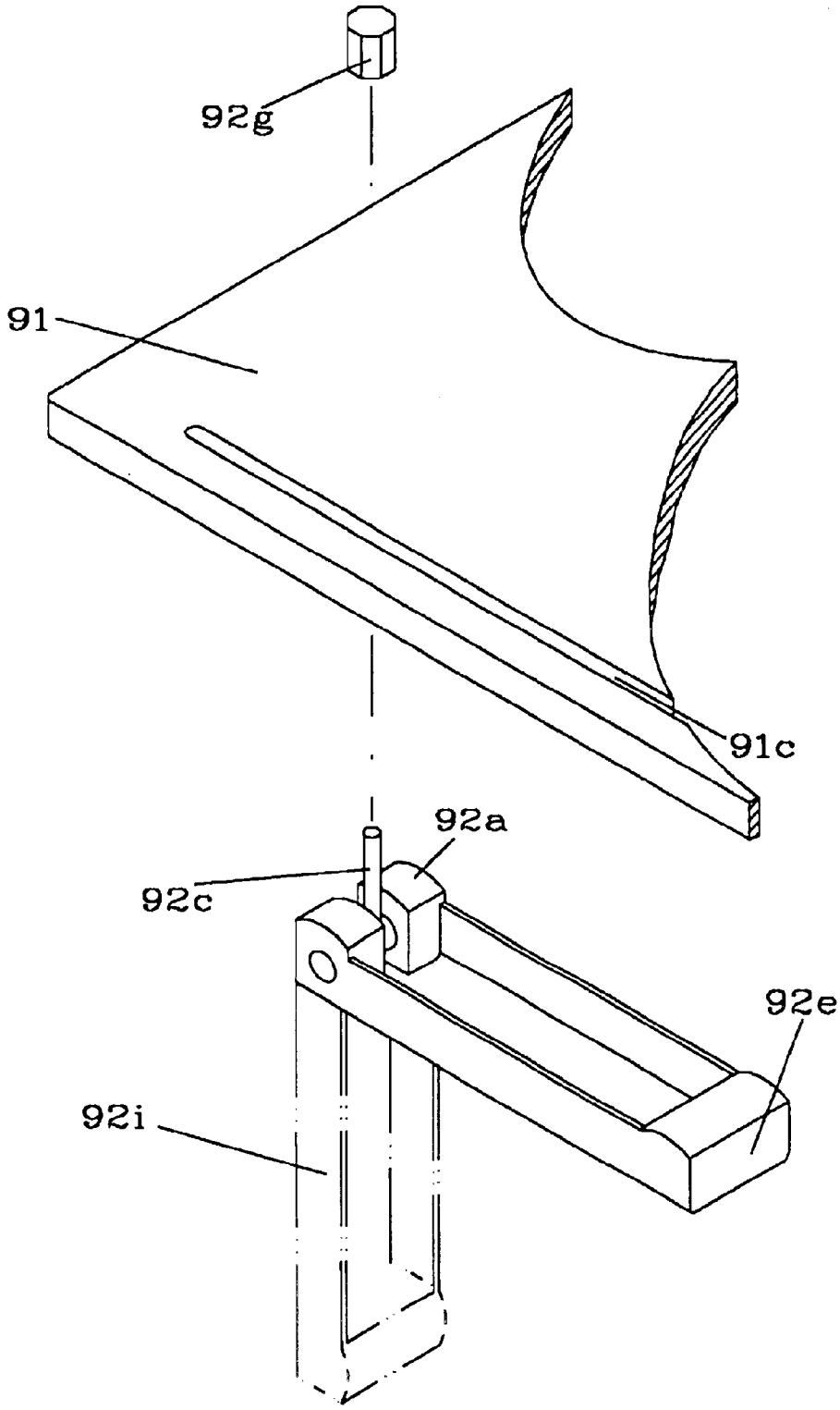
FIG. 13 is a cutaway view of a portion of the table support platform and cam latching mechanism.

In FIG. 13, a portion of the table support platform 91 is shown with slot 91*c*, cam latching mechanism 92*a* with screw section 92*c* and lever 92*e*, and nut 92*g* which will be embedded into the underneath side of the table.

In phantom is lever 92*i* showing the lever in an open position for assembly of cam latching mechanism 92*a* to the table. Screw section 92*c* of cam latching mechanism 92*a* passes through platform slot 91*c*, and screws into nut 92*g* embedded into the underneath surface of the table.

Figure 14:
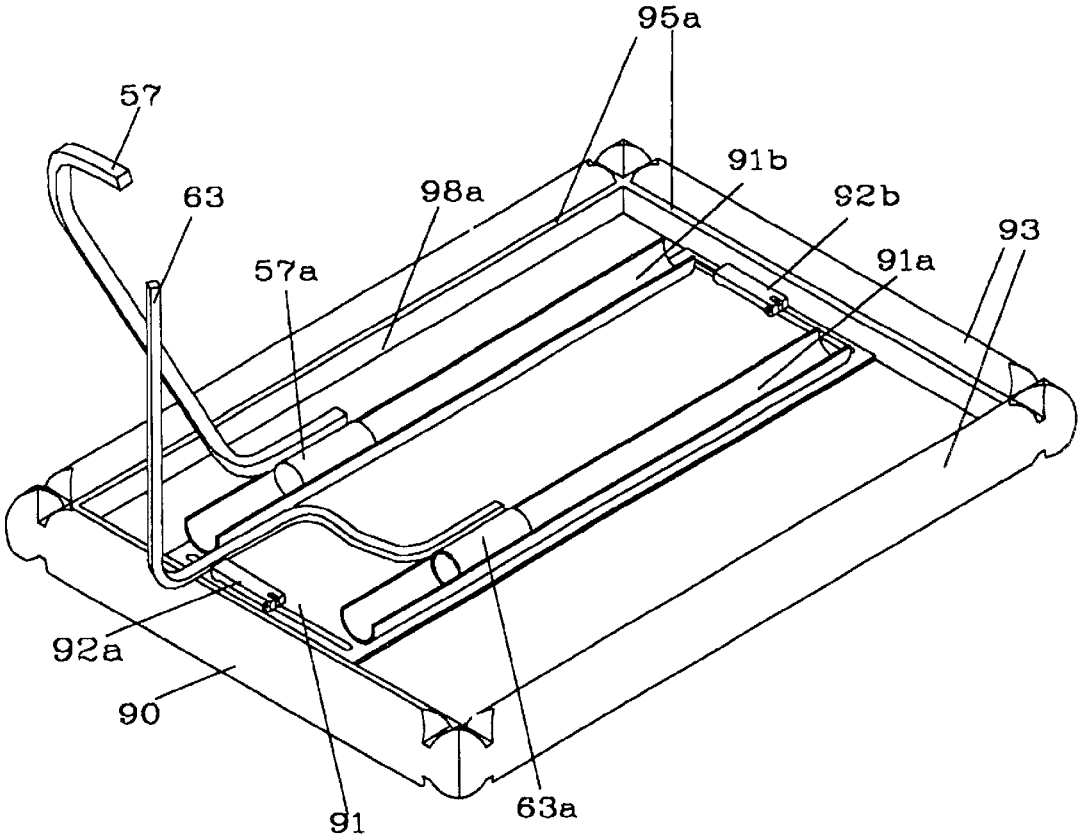
FIG. 14 is a view of the underneath side of the table.

Shown in FIG. 14 is an assembled view of the underneath side of table 90 with table support platform 91 with channel members 91*a* and 91*b*, and cam latching mechanism 92*a*/92*b* shown in a locked position.

The table support platform 91 is positioned in a recessed area 98*a* inside the grooves 95*a* that are inside edges 93 on the underneath side of table 90.

The cam latching mechanism 92*a*/92*b* slideably attach table support platform 91 to the underneath surface of the table 90 with screw sections of cam latching mechanism 92*a*/92*b* passing through the platform slots, and into the nuts embedded into the recessed area 98*a* of table 90.

As the cam latching mechanism levers are released, the table 90 can be positional in proximity to user, either closer or further away, by sliding the table forward or backward along the slots, and then secured by returning the cam latching mechanism levers to the locked position. The cam latching mechanism pulls the underneath surface of table 90 against the platform 91 for the locked position.

The table 90 is supported by circular support segments 57*a* and 63*a* that are slideably entrapped inside the table circular channels 91*b* and 91*a* that are fixedly attached to table support platform 91. The circular support segments 57*a* and 63*a* can rotate about the common axis of the support segments 57*a* and 63*a* and the channels 91*a* and 91*b* for level-to-tilted positioning and to slide from side-to-side for left-to-right placement adjustment.

The table support/tilt arm 57 will be secured to the table level/tilt adjustment mechanism. The table support/rotation arm 63 will be inserted into the table horizontal adjustment mechanism.

Figure 15:
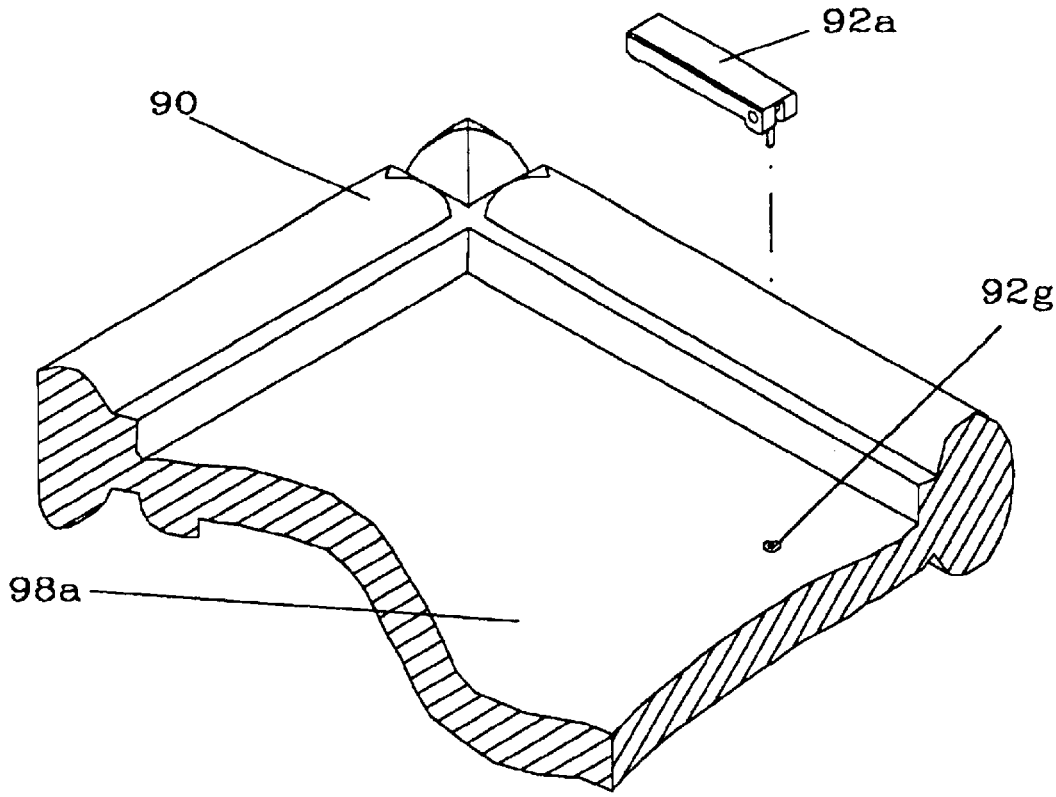
FIG. 15 is a cutaway view of underneath side of the table, without the table support platform.

FIG. 15 shows a portion of the underneath side of table 90 without the table support platform in place, with cam latching mechanism 92*a* and the nut 92*g* that is embedded into the recessed area 98*a*.

Figure 16:
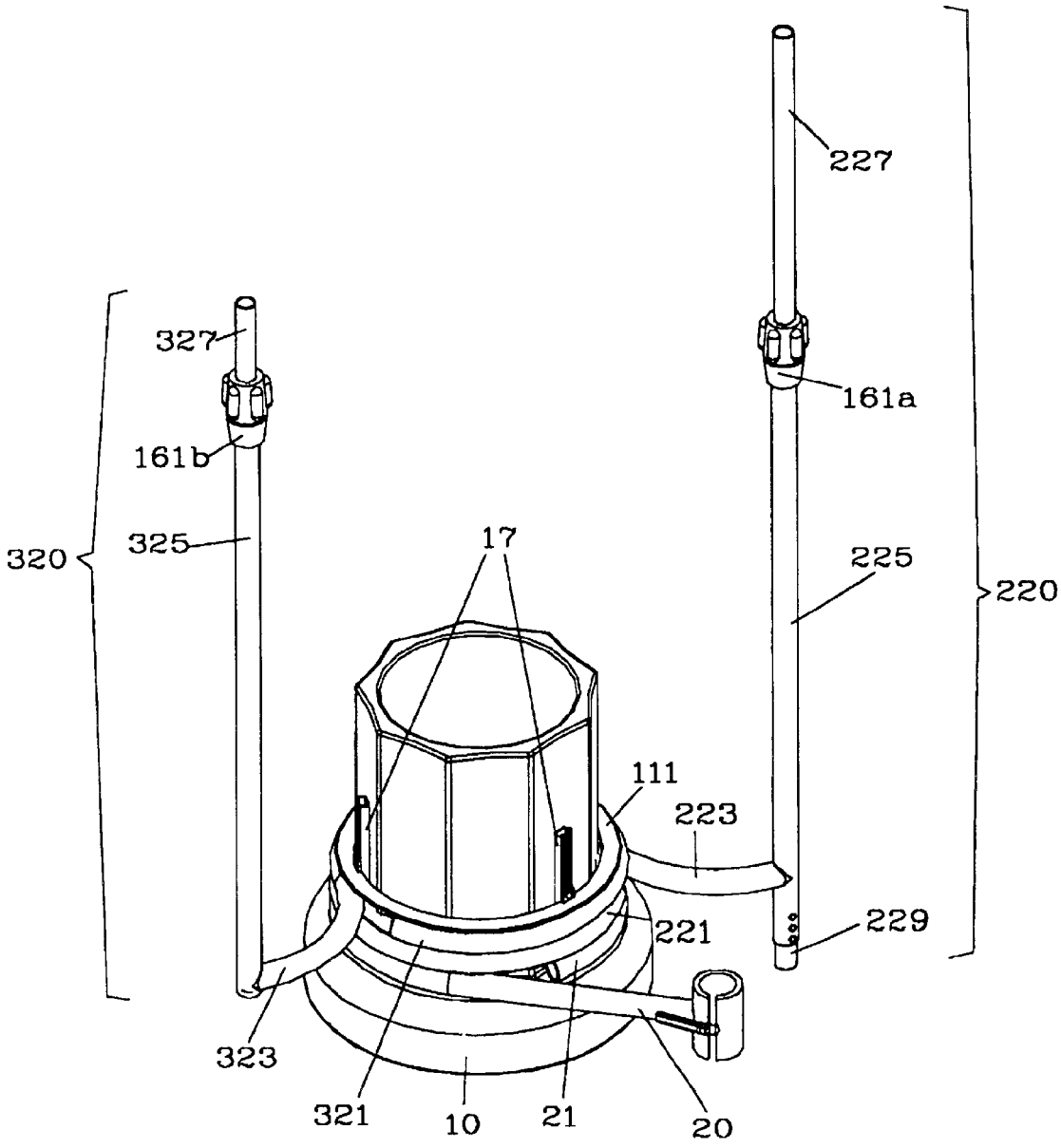
FIG. 16 is an assembled view of the base, three different extension apparatus mechanisms, and the entrapment ring.

In FIG. 16 is shown the base 10 with extension apparatus mechanism 20, an auxiliary extension apparatus mechanism 220, and a supplementary extension apparatus mechanism 320.

The supplementary extension apparatus mechanism 320 is comprised of a supplementary hookshaped extension section 321 and a supplementary extension support section 323, fixedly attached to a supplementary extension telescoping upright 325, affixed telescopically to a supplementary telescoping upright 327 with an adjusting mechanism 161*b* for vertical and/or rotational positioning of upright 327 and any accessory attached to upright 327.

The auxiliary extension apparatus mechanism 220 is comprised of an auxiliary hook-shaped extension section 221 and an auxiliary extension support section 223, fixedly attached to an auxiliary extension telescoping upright 225, affixed telescopically to an auxiliary telescoping upright 227 with an adjusting mechanism 161*a*, and an auxiliary fulcrum upright 229 telescopically affixed to the bottom of auxiliary extension telescoping upright 225.

Upright 229 becomes a means for auxiliary extension apparatus mechanism 220 to reach the floor, creating a fulcrum point between the base 10 and uprights 225 and 227 and any accessory attached to the uprights.

Adjusting mechanism 161*a* provides for vertical and/or rotational positioning of upright 227, and any accessory attached to upright 227.

Entrapment ring 111 is shown attached to vertical channel strips 17 of base 10, to retain hookshaped extension sections 21, 221, and 321.

Figure 17:
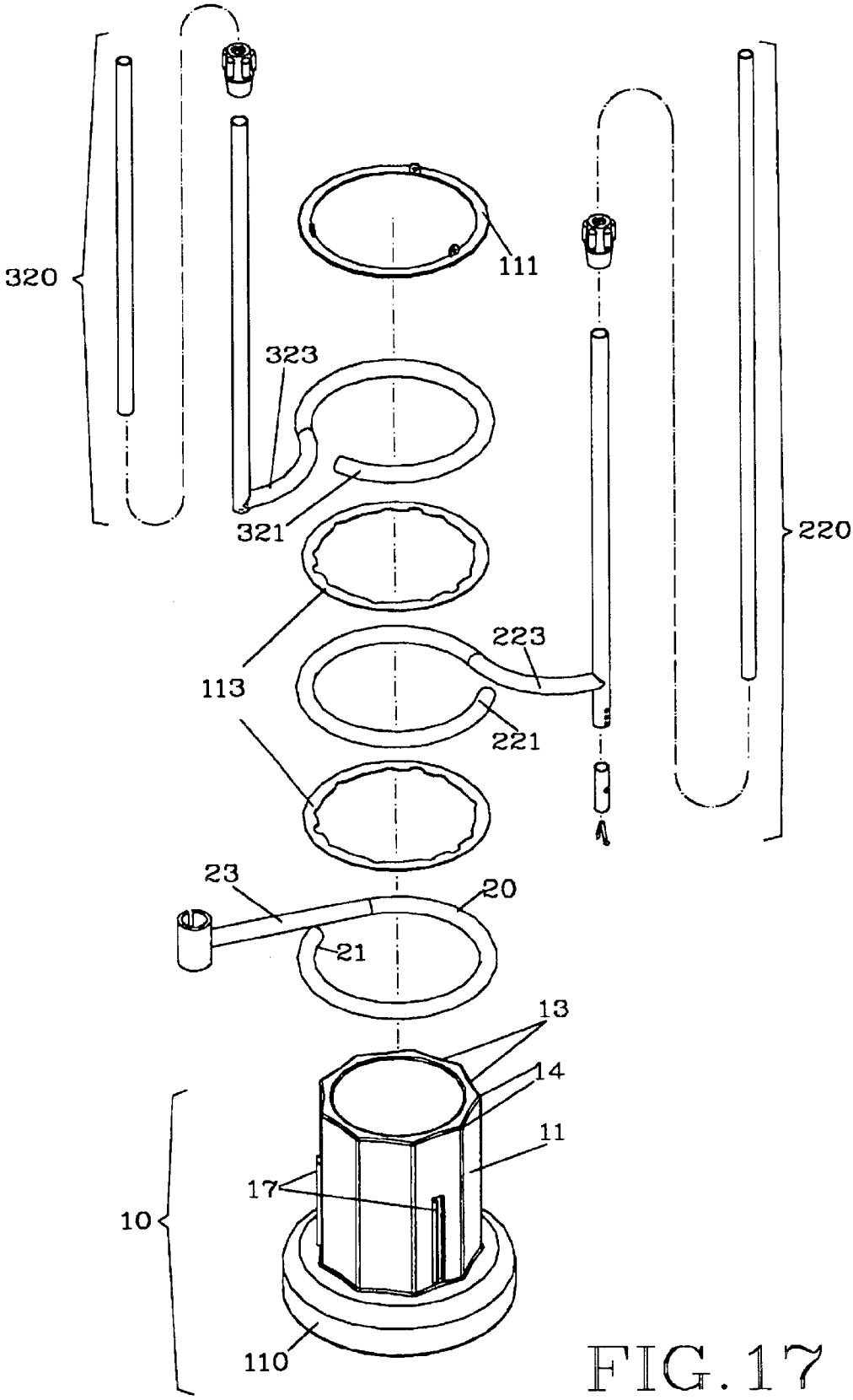
FIG. 17 is an exploded view of base, three extension apparatus mechanisms, and entrapment ring.

FIG. 17. is an exploded view of the parts indicated in FIG. 16. The hook-shaped extension sections like 21, 221 and 321 slide over and around tower section 11, with a first hook-shaped section bearing on the top of the extended base section 110.

The hook-shaped extension sections may be of any shape and material as long as the hook-shaped extension section is allowed to encircle the tower section 11 of base 10.

Between each hook-shaped section of each extension apparatus mechanism is a non-rotating bearing spacer 113, shaped to coincide with the outer concave surfaces 13 and points 14, and allowing room to pass over the vertical channel strips 17 of tower section 11.

Spacer 113 is positioned on the tower section 11 to create a low friction surface between the rotating hook-shaped sections to allow an independent rotation of each hook-shaped extension section about the axis of base 10.

The extension apparatus mechanisms 20, 220 and 320 are rotationally encircling base 10 for attachments to be moved rotationally about the axis of base 10 for positioning. Such attachments include tables and other accessory items, such as, but not limited to, a light or document holder.

Additional hook-shaped extension sections will come to bear on the top of the preceding hookshaped extension section with a spacer 113 in between to create a stack of hook-shaped extension sections.

The number of extension apparatus mechanisms that can be stacked around tower section 11 depends on the hook-shaped extension sections vertical thickness and the height of the strips on the tower section.

Entrapment ring 111 retains the hook-shaped extension sections allowing them to rotate independently on a horizontal plane.

Each extension apparatus mechanism may or may not have a fulcrum point means between base 10 and table 90 or other attachments.

Figure 18:
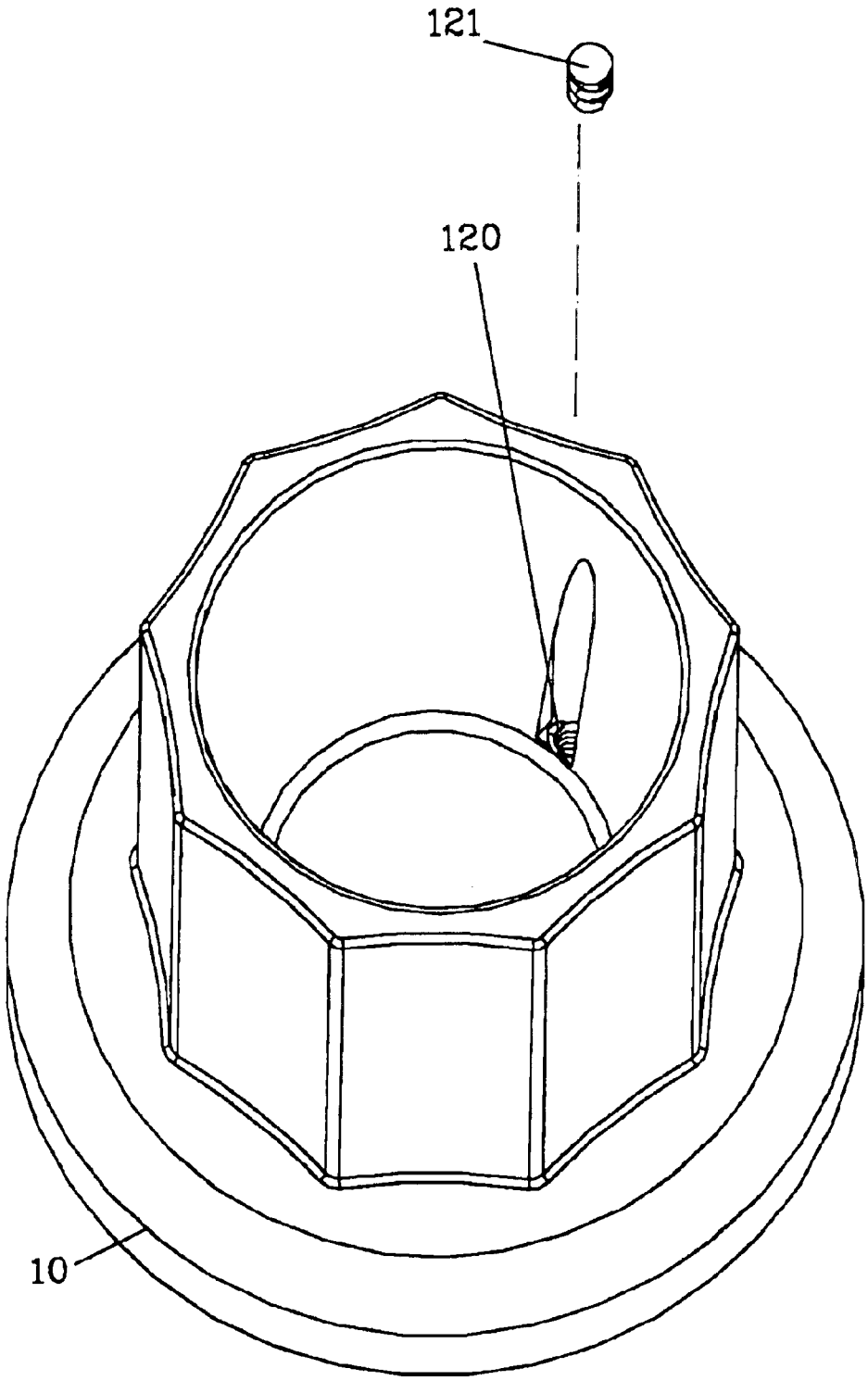
FIG. 18 is a view of the base with hole and fill plug for hollow cavity

In FIG. 18, an optional feature is shown, if the base 10 is manufactured with double walls to form a hollow chamber.

Hole 120 allows for any weighty substance such as a liquid, a gravel or pellet form, to be placed in or removed from the hollow chamber, for increasing or decreasing the weight of the base 10.

A fill plug 121, secured in the hole 120 in base 10, will retain the weighty substance in the hollow chamber.

Figure 19:
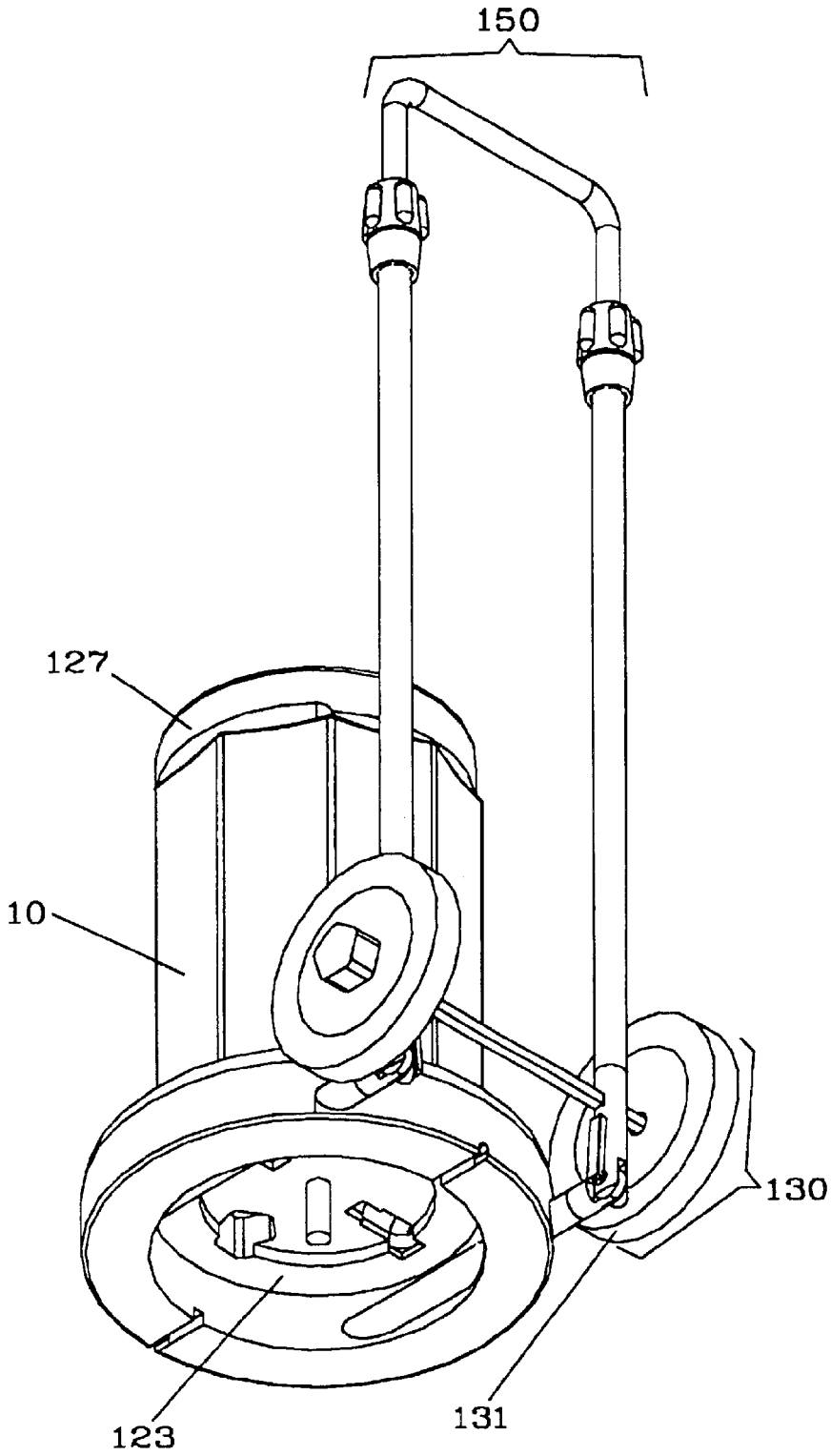
FIG. 19 is a view of handle assembly and wheel assembly

FIG. 19 shows an assembled view exposing the underneath side of base 10 and handle assembly mechanism 150 with an attachment of wheel assembly mechanism 130. On the underneath side of the base 10 is a concave cavity 123 providing an area for storage of accessory items, such as but not limited to, wheels, bearings and hubs, which will also add additional weight.

On top of the base 10 is a lid 127.

Figure 20:
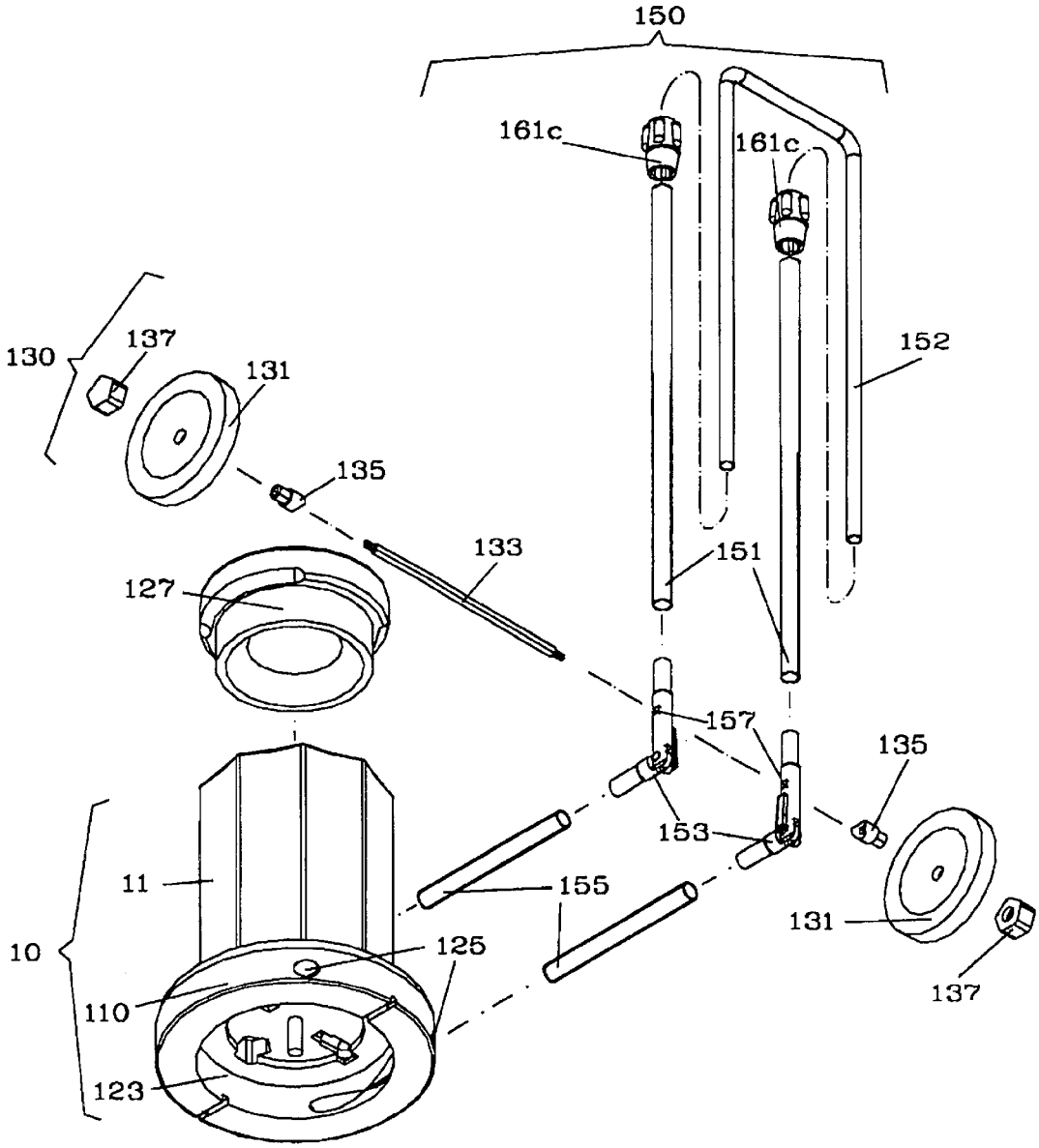
FIG. 20 is an exploded view of handle assembly and wheel assembly

Seen in FIG. 20, is an exploded view of the underneath side of extended base section 110 showing cavity 123 and receptor holes 125.

The receptor holes 125 will allow for additional attachment of accessories, such as, but not limited to wheels, or bracing to increase the overall stability.

Handle assembly mechanism 150 and wheel assembly 130 are also shown in FIG. 20.

The handle assembly mechanism 150 is comprised of a series of telescoping extensions 151 and 152, which is connected with hinge assembly mechanism 153 and linkage to connect to base 10.

Telescoping extensions 151 and 152 are telescopically attached with an adjusting mechanism 161*c*.

The hinge assembly mechanism 153 allows the telescoping extensions 151 and 152 to adjust from a straight extension that is parallel to the floor to an angle position to provide leverage for tipping the weight of the base 10 to the wheels 131. Linkage 155 of the handle assembly mechanism 150 passes through the receptor holes 125 in the extended base section 110, to become removeably secured to the base 10.

The wheel assembly mechanism 130, is comprised of wheels 131, shaft 133, bearings 135 and 10 hubs 137.

Shaft 133 passes through and beyond the holes 157 in the hinge assembly mechanism 153. Bearings 135 slide over the ends of the shaft 133. Wheels 131 slide over the bearings 135. Hubs 137 are secured to the ends of shaft 133.

When not in use, the wheel assembly mechanism 130 is un-assembled and stored in the bottom cavity 123 of the base 10.

Also shown in FIG. 20 is a lid 127, which fits into the inner concave cavity of the tower 11.

Figures 21, 21A:
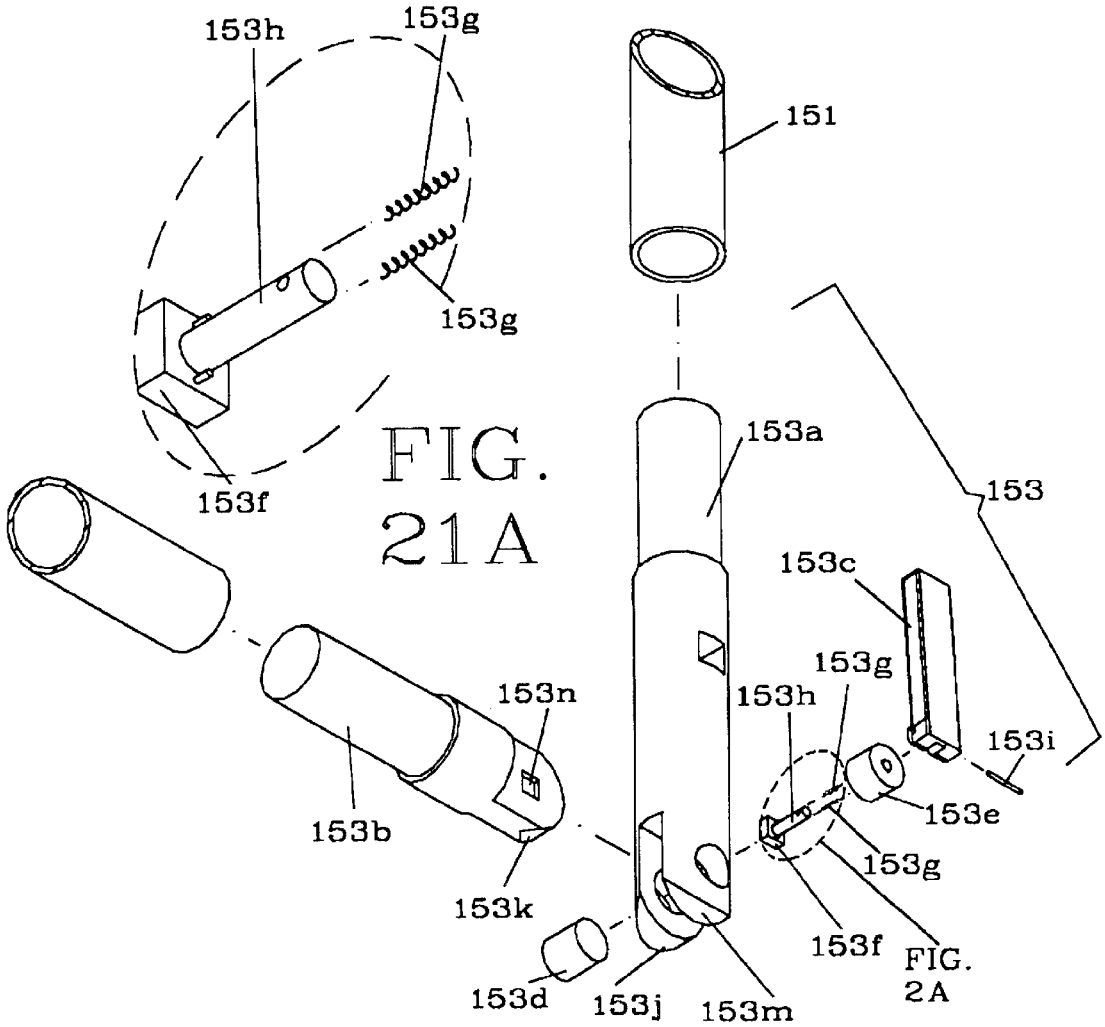
FIG. 21 is an exploded view of the hinge assembly of the handle assembly

Shown in FIG. 21, an exploded view of one of the hinge assembly mechanism 153, comprising hinge sections 153*a* and 153*b*, cam lever 153*c*, handle pintiles 153*d* and 153*e*, handle latching device 153*f*, and springs 153*g*.

Shaft 153*h* of handle latching device 153*f* passes through a hole in pintile 153*e*. Springs 153*g* are entrapped in cavities in pintile 153*e*.

Pin 153*i* passes through a hole in shaft 153*h* and is secured in the holes in cam lever 153*c*.

Two segments 153*j* and 153*m* protrude at one end of hinge section 153*a*, and converge with the one protruding segment 153*k* of hinge section 153*b* to form a hinge. Segments 153*j* and 153*m* have holes into which pintile 153*d* and 153*e* are secured.

Segment 153*k* of hinge section 153*b* has a cavity on one side for pintile 153*d* to nest after passing through a hole in segment 153*j*.

To retract the handle latching device 153*f* from the cavity 153*n* on hinge section 153*k*, cam lever 153*c* is rotated 90 degrees, which compresses the springs 153*g*.

The hinge section 153*a* along with secured telescoping extensions 151 will rotate from a vertical position to a horizontal position that is parallel to the floor, and cam lever 153*c* is then returned to the locked position.

Figure 22:
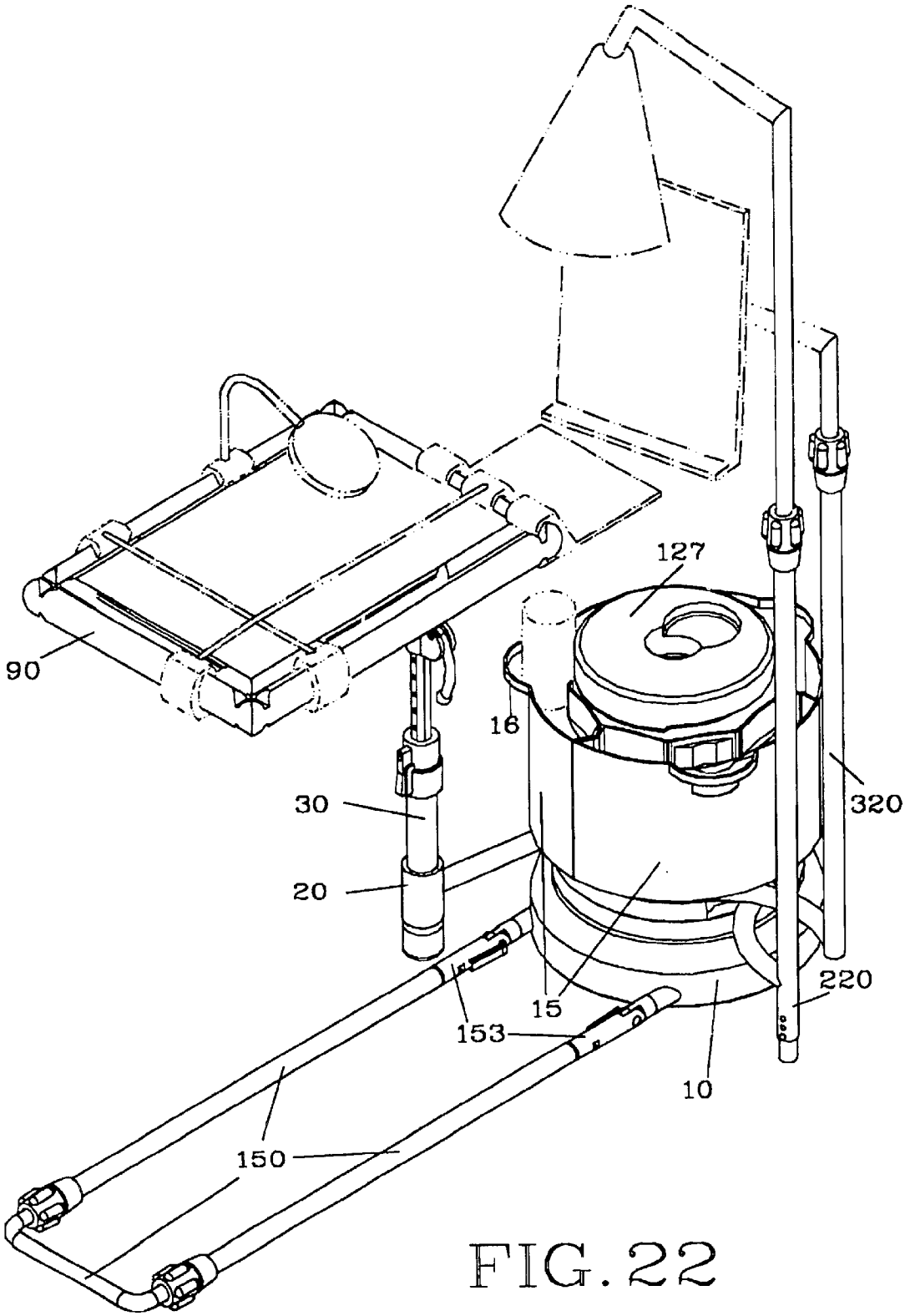
FIG. 22 is a composite view of the Universal Table and accessories

In FIG. 22, some accessory items and attachments for the Universal Table are shown as it might be commonly used.

Base 10, pockets 15, extension apparatus mechanism 20, table support assembly 30, table 90, auxiliary extension apparatus mechanism 220, supplemental extension mechanism 320, the handle assembly mechanism 150, the hinge assembly mechanism, and lid 127 are shown.

The auxiliary extension apparatus mechanism 220 is shown with an accessory of a light, shown in light phantom lines.

The supplemental extension mechanism 320 is shown with an accessory of a document holder, shown in light phantom lines.

Also shown in light phantom lines are accessories for the table 90, a table extension, a magnifying glass, and two book or magazine restraints, shown slid over the table edges.

A container is placed in the projection 16 of a pocket 15 on the base 10. The lid 127 also has a cavity for setting cans or cups.

SUMMARY

In summary, a Universal Table is assembled with one or more extension apparatus mechanisms placed with the hook-shaped extension section around the tower section of the base above the base extended section.

The hook-shaped extension or stack of hook-shaped extensions are trapped between the pockets of the base and the extended base section with spacers in such a manner as to allow the hook-shaped extension, auxiliary extension apparatus mechanism, supplementary extension apparatus mechanism, and other hook-shaped extensions, to rotate about the base independently of one another.

The table with the table support assembly mechanism is affixed to the extension mechanism assembly. The telescoping upright of the table support assembly mechanism is affixed telescopically into the latching assembly mechanism of the extension apparatus mechanism. The table support arms are entrapped into the table support platform that has been slideably secured to the table.

Options to affix to the table include, but are not limited to, book or magazine restraints, a magnifying glass, or a table extension.

Options to affix to the auxiliary extension mechanism assembly and/or the supplementary extension mechanism assembly include, but are not limited to, an umbrella, a document holder, or a light.

By pushing left or right on the lever of the table horizontal adjustment mechanism, the clamshell is hinged open against the spring tension, releasing the brake pressure exerted against the upright, and allowing clamshell, clamp, upright, and any attached components, to rotate about the axis of the upright.

Once the components have rotated to the desired position, the long leg of the lever is released, allowing the spring tension to pull the clamshell sections together, engaging the brakes against the upright.

Many types of public domain hardware, such as snap buttons, braking clamps, friction clamps, and spring clamps can perform the same or similar functions as the latching mechanism, the latching devices, the vertical adjustment mechanism, and the adjusting mechanism.

After assembly, the Universal Table is ready for immediate use as, but not limited to, an organizer for multiple items, an easel, a document/book holder, or a display table. It is also ready to be positioned near any chair, couch, bed, hammock, or lawn furniture; in a home, office, waiting room, or outside; with the storage area in the base for needed supplies and for personal items, as desired by the user. This is a Universal Table that can be used by any person, whether standing, seated, reclining, or laying down, with adjustment mechanisms designed to be easy for all to manipulate, especially those with physical dexterity limitations.

Although only one configuration of the invention is shown and described in the figures, the invention is not limited to the above description and includes a variety of specific designs. It is believed apparent that the invention is not necessarily confined to the specific use described above, since it may be utilized for any purpose to which it may be suited. Nor is the invention necessarily limited to the specific construction illustrated and described, since such construction is only intended to be illustrative of the principles of operation, it being considered that the invention comprehends any minor change.

That which is claimed is:

1. An article of furniture for holding items comprising a base, an extension apparatus mechanism, and an attachment support assembly mechanism, (a) said base comprising an extended base section, a tower section, and an entrapment ring, said base having a low-center of gravity and being of sufficient weight to provide adequate ballast for various attachments linked to said base, underneath side of said extended base section comprising receptor holes for attachment of various accessories, said tower section having an inner concave cavity centering on said tower's axis extending substantially down into said tower section, said inner concave cavity means for holding various items, said tower section having outside concave surfaces creating indexing point means for minimizing contact between said extension apparatus mechanism and said tower of said base, with an attaching means of vertical channel strips on said outside concave surfaces, said entrapment ring secured to said tower section of said base above said extension apparatus mechanism, said entrapment ring means for retaining said extension apparatus mechanism and for permitting unencumbered rotational movement of said extension apparatus mechanism and said attachment support assembly mechanism around the vertical axis of said tower of said base, said base having pockets releasably attached to outside of said tower with a projection strip means for interacting with said attaching means of vertical channel strips on said outside concave surfaces of said tower section, said pockets having a cavity with a bottom and an outer rim, (b) said extension apparatus mechanism comprising a hook-shaped section and an extension support section, said hook-shaped section rotationally encircles said tower section of said base, said extension support section having a clamping sleeve with a latching mechanism means for connecting said base to said attachment support assembly mechanism, said hook-shaped extension section permitting rotational movement of said extension apparatus mechanism and said attachment support assembly mechanism to a multiplicity of positions by sliding rotationally around said vertical axis of said tower, said rotational movement being on a horizontal plane parallel to the floor, (c) said attachment support assembly mechanism means for supporting various attachment members, such as a table, whereby the combination of said base, said extension apparatus mechanism, and said attachment support assembly mechanism provide a freestanding usable and conveniently adjustable adaptable working, eating, playing or storage area that can be used alone, or can be located near a chair or a lounging surface for a person in various seated, reclining, or laying positions with all adjustments being made easily and fixed securely, and whereby the combination of said base, said extension apparatus mechanism, said attachment support mechanism to be assembled for use on either the right or left side of said person in various standing, seated, reclining, or laying positions with all adjustments being made easily and fixed securely.

2. An article of furniture of claim 1, wherein said pockets of said base have a projection, whereby said projection being a gripping area for placement and removal of said pocket on said base, and being an area for setting such items as a cup or a glass.

3. An article of furniture of claim 1, wherein said base is manufactured with double walls to form a hollow chamber, an opening in said base for access to said hollow chamber, and a removable fill plug, whereby any weighty substance placed in or removed from the chamber in said base, increases or decreases the weight of said base, whereby the combination of said base, said extension apparatus mechanism, and said attachment support assembly mechanism, providing a freestanding usable storage area and convenient adjustable adaptable working, eating, or playing surface that can be used alone, or can be located near a chair or a lounging surface for a person in various seated, reclining, or laying positions with all adjustments being made easily and fixed securely, and whereby the combination of said base, said extension apparatus mechanism, said attachment support mechanism to be assembled for use on either the right or left side of said person in various standing, seated, reclining, or laying positions with all adjustments being made easily and fixed securely.

4. An article of furniture of claim 1, wherein said attachment support assembly mechanism comprising a table support assembly mechanism and a table, (a) said table support assembly mechanism comprising a telescoping vertical mechanism, a table level/tilt adjustment mechanism, a table horizontal adjustment mechanism, and a table support platform, (1) said telescoping vertical mechanism comprising a telescoping upright, a vertical adjustment mechanism, a non-rotating telescoping upright, a round upright, and a hollow upright, said telescoping upright being removably attached to said clamping sleeve of said extension apparatus mechanism, a fulcrum point created at lowest end of said telescoping upright, which rests on a floor, said telescoping upright telescopically affixed to said round upright and said non-rotating telescoping upright with said vertical adjustment mechanism, said non-rotating telescoping upright securely affixed to said round upright, said hollow upright rotatably attached to said round upright, said telescoping vertical mechanism providing vertical positioning of said table, said telescoping vertical mechanism providing horizontal positioning of said table by pivoting about the common axis of said round upright and said hollow upright, (2) said table level/tilt adjustment mechanism comprising a slide body, a handle, a brake, and a table support/tilt arm, said slide body slideably affixed to said hollow upright of said telescoping vertical mechanism, said slide body having holed brackets for affixing said handle and said table support/tilt arm, said handle having a cam action end means for activating said brake against said hollow upright, said table support/tilt arm comprising a configured bar and a circular support segment, end of said configured bar pivotally affixed to one of said holed brackets of said slide body, and said circular support segment entrapped into said table support platform, said table level/tilt adjustment mechanism means for altering the position of said table support platform to a position parallel to the floor or tilted to various angles, even to beyond perpendicular, and lock desired position in place, (3) said table horizontal adjustment mechanism comprising of a clamp, a table support/rotation arm, a clamshell, a guide, a cover, and a lever, said clamp fixedly secured to said hollow upright of said telescoping vertical mechanism, said clamp having a pintile with a pintile latching device means for connecting to said cover, said table support/rotation arm comprising a configured bar and a circular support segment, end of said configured bar rotationally affixed into a cavity in the upper end of said round upright of said telescoping vertical mechanism, said circular support segment entrapped into said table support platform, said clamshell comprising of clamshell segments with various predetermined cutout areas, predetermined abutting areas, offsetting holed loop extensions, a brake mechanism and a spring pulling mechanism, said brake mechanism adjustably secured to each said clamshell segment tangent to said cutout area and contiguous to said round upright of said telescoping vertical mechanism for stopping the movement of said clamshell from rotating about the vertical axis of said round upright, and when said brake mechanism is released said clamshell to be permitted to rotate about said vertical axis of said round upright, said spring pulling mechanism secured to each said clamshell segment in said abutting area, said spring pulling mechanism being a tension means for pulling said clamshell's segments together, said guide comprising a predetermined cutout area and an extension arm positioned over said cutout area of said clamshell, said cover comprising an arm hole and a receiver for said pintile latching device of said clamp, said cover overlays said clamshell fastening onto said clamp, and said lever comprising a long leg and a short leg, said short leg positioned through said cutout area of said clamshell and affixed to said cutout area of said guide, said table horizontal adjustment mechanism means for rotating movement of said table on a horizontal plane about the common axis of said round upright and said hollow upright of said telescoping vertical mechanism, and for securing said table in position after rotation, (4) and said table support platform comprising a planar surface with predetermined circular channel members and predetermined slots and a cam latching mechanism, said planar surface being slideably attached through said slots to the underneath side of said table with said cam latching mechanism, said circular channel members aligned parallel with a predetermined separation, entrapping said circular support segment of said table support/tilt arm of said table level/tilt adjustment mechanism and said circular support segment of said table support/rotation arm of said table horizontal adjustment mechanism, with slide adjustment means for sliding said circular support segments in said circular channel members and rotating said circular support segments about a common axis, said table support platform supporting said table, said table support platform means for allowing said table to be horizontally adjustable along a horizontal axis, as in closer or further away, and said table support platform means for allowing said table to be horizontally adjustable along said horizontal axis, as in from left to right, (b) and said table comprising a top side and an underneath side, with encompassing edges, said top side comprising an article-supporting surface, an insert wall, predetermined grooves between said article-supporting surface and said edges, predetermined indentions extending inwardly into said article-supporting surface inside said grooves, and predetermined notches extending inward from said insert wall, said article-supporting surface being an area for an optional table insert, said table insert being held in place with said notches, said indentions being an area for a fingertip to get under said insert for releasing from said notches for removal of said insert, said said underneath side comprising a platform attaching area and predetermined grooves between said platform attaching area and said edges, said platform attaching area means for slideably attaching said table support platform to said cam latching mechanism, and said grooves, on the top side and the underneath side of said table, and said edges creating a continuous passage for a non-rotating attachment mechanism of an accessory device to slide onto said table, said table supported with said table support assembly mechanism attached to said extension apparatus mechanism connected to said base, whereby said table being positional horizontally and vertically to a user with said telescoping vertical mechanism, whereby said table being adjustable for positions parallel to the floor or tilted to various angles, even to beyond perpendicular, and lock desired position in place, with said table level/tilt adjustment mechanism, whereby said table being positional to a user with said table horizontal adjustment mechanism of said table support assembly mechanism, whereby the combination of said base, said extension apparatus mechanism, and said attachment support mechanism, provide a freestanding usable storage area and convenient adjustable adaptable positional working, eating, or playing surface that can be used alone, or can be located near a chair or a lounging surface for a person in various seated, reclining, or laying positions, and whereby the combination of said base, said extension apparatus mechanism, said attachment support mechanism to be assembled for use on either the right or left side of said person in various standing, seated, reclining, or laying positions with all adjustments being made easily and fixed securely.

5. An article of furniture of claim 4, wherein said telescoping upright of said telescoping vertical mechanism comprising a removable tip at the bottom of said telescoping upright, whereby said removable tip means for more stabilizing of the fulcrum point created between said base and said table, whereby the combination of said base, said extension apparatus mechanism, said table support assembly mechanism, said removable tip, and said table providing a freestanding usable storage area and convenient adjustable adaptable working, eating, or playing surface that can be used alone, or can be located near a chair or a lounging surface for a person in various seated, reclining, or laying positions with all adjustments being made easily and fixed securely, and whereby the combination of said base, said extension apparatus mechanism, said attachment support mechanism to be assembled for use on either the right or left side of said person in various standing, seated, reclining, or laying positions with all adjustments being made easily and fixed securely.

6. An article of furniture of claim 1, further including a handle assembly mechanism and a wheel assembly mechanism, (a) said handle assembly mechanism comprising a series of telescoping extensions connected with a hinge assembly mechanism and linkage means for being removeably secured to said base, said hinge assembly mechanism means for allowing said telescoping extensions to adjust from a straight extension parallel to a floor to an angle position providing leverage for tipping the weight of said base to said wheels, (b) said wheel assembly mechanism means for moveability of said article of furniture, whereby said handle assembly mechanism and said wheel assembly mechanism can be disassembled and stored in underneath side of said extended base section, whereby the combination of said base, said extension apparatus mechanism, said attachment support mechanism, said handle assembly mechanism and said wheel assembly mechanism provide a freestanding moveable usable storage area and convenient adjustable adaptable positional working, eating, or playing surface that can be used alone, or can be located near a chair or a lounging surface for a person in various seated, reclining, or laying positions, and whereby the combination of said base, said extension apparatus mechanism, said attachment support mechanism, said handle assembly mechanism and said wheel assembly mechanism to be assembled for use on either the right or left side of said person in various standing, seated, reclining, or laying positions with all adjustments being made easily and fixed securely.

7. An article of furniture of claim 1, further including a lid, of predetermined size and formation to fit onto the top of the inner concave cavity of the tower, whereby the combination of said base, said extension apparatus mechanism, said attachment support mechanism, and said lid provide a freestanding usable storage area and convenient adjustable adaptable positional working, eating, or playing surface that can be used alone, or can be located near a chair or a lounging surface for a person in various seated, reclining, or laying positions, and with all adjustments being made easily and fixed securely, and whereby the combination of said base, said extension apparatus mechanism, said attachment support mechanism to be assembled for use on either the right or left side of said person in various standing, seated, reclining, or laying positions with all adjustments being made easily and fixed securely.

8. An article of furniture of claim 1, further including an auxiliary extension apparatus mechanism and a spacer, (a) said auxiliary extension apparatus mechanism comprising an auxiliary extension hook-shaped section and an auxiliary extension support section, said auxiliary hook-shaped section rotationally encircling said tower section of said base, said auxiliary extension support section fixedly attached to an auxiliary telescoping vertical mechanism, said auxiliary telescoping vertical mechanism comprising an auxiliary extension telescoping upright affixed telescopically to an auxiliary telescoping upright with an adjusting mechanism, and an auxiliary fulcrum upright telescopically affixed to the bottom of said auxiliary extension telescoping upright, said auxiliary hook-shaped extension section means for permitting unencumbered rotational movement of said auxiliary extension apparatus mechanism to a multiplicity of positions by sliding rotationally around said vertical axis of said tower, said rotational movement being on a horizontal plane parallel to the floor, said auxiliary telescoping vertical mechanism means for connecting an attachment for various accessories and providing vertical positioning of said accessories, said auxiliary telescoping vertical mechanism means for providing horizontal positioning of said accessories by pivoting about the common axis of said uprights, (b) said spacer shaped to coincide with said outer concave surfaces and said points of said tower of said base and allowing room to pass over said vertical channel strips on said tower, said spacer being a non-rotating bearing device for retaining means of a plurality of said extension apparatus mechanisms and said auxiliary extension apparatus mechanisms, said spacer secured to said base between each of said apparatus mechanisms, said spacer means for permitting unencumbered independent rotation of each said hook-shaped extension sections about said vertical axis of said base, whereby said auxiliary extension telescoping upright being an interacting telescoping member affixed telescopically with said adjusting mechanism for plurality of vertical and horizontal positioning orientations of said attachments or said accessories relative to said base, whereby said auxiliary extension apparatus means for supporting said attachments and said accessories, and providing rotational adjustment of said attachments and said accessories around said base, being positional to in front of or to a multiplicity of positions beside said user, whereby said accessories being positional to beside a user with said auxiliary horizontal adjustment mechanism of said auxiliary extension apparatus mechanism, whereby a fulcrum point being created at lowest end of said auxiliary fulcrum upright, which rests on a floor, whereby the combination of said base, said extension apparatus mechanism, said attachment support assembly mechanism, and said auxiliary extension apparatus mechanism, to be assembled for use on either the right or left side of said person in various standing, seated, reclining, or laying positions with all adjustments being made easily and fixed securely, and whereby the combination of said base, said extension apparatus mechanism, said attachment support assembly mechanism, and said auxiliary extension apparatus mechanism providing a freestanding usable storage area and convenient adjustable adaptable working, eating, or playing surface that can be used alone, or can be located near a chair or a lounging surface for a person in various seated, reclining, or laying positions with all adjustments being made easily and fixed securely.

9. An article of furniture of claim 1, further including a supplementary extension apparatus mechanism and a spacer, (a) said supplementary extension apparatus mechanism comprising a supplementary hook-shaped section and a supplementary extension support section, said supplementary hook-shaped section rotationally encircling said tower section of said base, said supplementary extension support section fixedly attached to a supplementary telescoping vertical mechanism, said supplementary telescoping vertical mechanism comprising an supplementary extension telescoping upright affixed telescopically to an supplementary telescoping upright with an adjusting mechanism, said supplementary hook-shaped extension section means for permitting unencumbered rotational movement of said supplementary extension apparatus mechanism to a multiplicity of positions by sliding rotationally around said vertical axis of said tower, said rotational movement being on a horizontal plane parallel to the floor, said supplementary telescoping vertical mechanism means for connecting an attachment for various accessories and providing vertical positioning of said accessories, said supplementary telescoping vertical mechanism means for providing horizontal positioning of said accessories by pivoting about the common axis of said uprights, (b) said spacer shaped to coincide with said outer concave surfaces and said points of said tower of said base and allowing room to pass over said vertical channel strips on said tower, said spacer being a non-rotating bearing device for retaining means of a plurality of said extension apparatus mechanisms and said supplementary extension apparatus mechanisms, said spacer secured to said base between each of said apparatus mechanisms, said spacer means for permitting unencumbered independent rotation of each said hook-shaped extension sections about said vertical axis of said base, whereby said supplementary extension telescoping upright being an interacting telescoping member affixed telescopically with said adjusting mechanism means for a plurality of vertical and horizontal positioning orientations of said attachment means or said accessories relative to said base, whereby said supplementary extension apparatus means for supporting said attachments and said accessories, and providing rotational adjustable of said attachments and said accessories around said base, being positional to in front of or to a multiplicity of positions beside said user, whereby said accessories being positional to beside a user with said supplementary horizontal adjustment mechanism of said supplementary extension apparatus mechanism, whereby the combination of said base, said extension apparatus mechanism, said attachment support assembly mechanism, and supplementary extension apparatus mechanism to be assembled for use on either the right or left side of said person in various standing, seated, reclining, or laying positions with all adjustments being made easily and fixed securely, and whereby the combination of said base, said extension apparatus mechanism, said attachment support assembly mechanism, and said supplementary extension apparatus mechanism, provide a freestanding usable storage area and convenient adjustable adaptable positional working, eating, or playing area that can be used alone, or can be located near a chair or a lounging surface for a person in various seated, reclining, or laying positions.

10. An article of furniture of claim 1 further including an auxiliary extension apparatus mechanism, a supplementary extension apparatus mechanism, and a plurality of spacers, (a) said auxiliary extension apparatus mechanism comprising a hook-shaped section and an auxiliary extension support section, said auxiliary hook-shaped section rotationally encircling said tower section of said base, said auxiliary extension support section fixedly attached to an auxiliary telescoping vertical mechanism, said auxiliary telescoping vertical mechanism comprising an auxiliary extension telescoping upright affixed telescopically to an auxiliary telescoping upright with an adjusting mechanism, and an auxiliary fulcrum upright telescopically affixed to the bottom of said auxiliary extension telescoping upright, said auxiliary hook-shaped extension section means for permitting unencumbered rotational movement of said auxiliary extension apparatus mechanism to a multiplicity of positions by sliding rotationally around said vertical axis of said tower, said rotational movement being on a horizontal plane parallel to the floor, said auxiliary telescoping vertical mechanism means for connecting an attachment means for various accessories and providing vertical positioning of said accessories, said auxiliary telescoping vertical mechanism means for providing horizontal positioning of said accessories by pivoting about the common axis of said uprights, (b) said supplementary extension apparatus mechanism comprising a supplementary hook-shaped section and an supplementary extension support section, said supplementary hook-shaped section rotationally encircling said tower section of said base, said supplementary extension support section fixedly attached to a supplementary telescoping vertical mechanism, said supplementary telescoping vertical mechanism comprising an supplementary extension telescoping upright affixed telescopically to an supplementary telescoping upright with an adjusting mechanism, said supplementary hook-shaped extension section means for permitting unencumbered rotational movement of said supplementary extension apparatus mechanism to a multiplicity of positions by sliding rotationally around said vertical axis of said tower, said rotational movement being on a horizontal plane parallel to the floor, said supplementary telescoping vertical mechanism means for connecting an attachment for various accessories and providing vertical positioning of said accessories, said supplementary telescoping vertical mechanism means for providing horizontal positioning of said accessories by pivoting about the common axis of said uprights, (c) said spacers shaped to coincide with said outer concave surfaces and said points of said tower of said base and allowing room to pass over said vertical channel strips on said tower, said spacers each being a non-rotating bearing device for retaining means for a plurality of said extension apparatus mechanisms, said auxiliary extension apparatus mechanisms, and supplementary extension apparatus mechanisms, said spacers secured to said base between each of said apparatus mechanisms, said spacers means for permitting unencumbered independent rotation of each said hook-shaped extension section about said vertical axis of said base, whereby said auxiliary extension telescoping upright being an interacting telescoping member affixed telescopically with said adjusting mechanism means for a plurality of vertical and horizontal positioning orientations of said attachments or said accessories relative to said base, whereby said supplementary extension telescoping upright being an interacting telescoping member affixed telescopically with said adjusting mechanisms for a plurality of vertical and horizontal positioning orientations of said attachments or said accessories relative to said base, whereby each said extension apparatus mechanism means for providing support for said attachments and said accessories, and providing rotational adjustable of said attachments and said accessories around said base, being positional to in front of or to a multiplicity of positions beside said user, whereby said accessories being positional to beside a user with each of said horizontal adjustment mechanism, whereby a fulcrum point being created at lowest end of said telescoping upright of auxiliary extension apparatus mechanism, which rests on a floor, whereby said adjustment mechanisms providing a plurality of positioning as to vertical orientation or pivotal orientation of said base to said attachments or said accessories, whereby the combination of said base, said extension apparatus mechanism, said attachment support assembly mechanism, said auxiliary extension apparatus mechanism, and said supplementary extension apparatus mechanism to be assembled for use on either the right or left side of said person in various standing, seated, reclining, or laying positions with all adjustments being made easily and fixed securely, and whereby the combination of said base, said extension apparatus mechanism, said attachment support assembly mechanism, said auxiliary extension apparatus mechanism, and supplementary extension apparatus mechanism provide a freestanding usable storage area and convenient adjustable adaptable positional working, eating, or playing area that can be used alone, or can be located near a chair or a lounging surface for a person in various seated, reclining, or laying positions.

11. An article of furniture comprising a base, an auxiliary extension apparatus mechanism, a supplementary extension apparatus mechanism, and a plurality of spacers, (a) said base comprising an extended base section, a tower section, and an entrapment ring, said base having a low-center of gravity and being of sufficient weight to provide adequate ballast for various attachments linked to said base, underneath side of said extended base section having receptor holes for attachment of various accessories, said tower section having an inner concave cavity centering on said tower's axis extending substantially down into said tower section, said inner concave cavity means for holding various items, said tower section having outside concave surfaces creating indexing point means for minimizing contact between said extension apparatus mechanism and said tower of said base, with an attaching means of vertical channel strips on said outside concave surfaces, said entrapment ring secured to said tower section of said base above said extension apparatus mechanism for retaining means of said extension apparatus mechanism, said entrapment ring means for permitting unencumbered rotational movement of said extension apparatus mechanism and said attachment support assembly mechanism around the vertical axis of said tower of said base, said base having pockets releasably attached to outside of said tower with a projection strip means for interacting with said attaching means of vertical channel strips on said tower section, said pockets having a cavity with a bottom and an outer rim, (b) said auxiliary extension apparatus mechanism comprising a auxiliary hook-shaped section and an auxiliary extension support section, said auxiliary hook-shaped section rotationally encircling said tower section of said base, said auxiliary extension support section fixedly attached to an auxiliary telescoping vertical mechanism, said auxiliary telescoping vertical mechanism comprising an auxiliary extension telescoping upright affixed telescopically to an auxiliary telescoping upright with an adjusting mechanism, and an auxiliary fulcrum upright telescopically affixed to the bottom of said auxiliary extension telescoping upright, said auxiliary hook-shaped extension section means for permitting unencumbered rotational movement of said auxiliary extension apparatus mechanism to a multiplicity of positions by sliding rotationally around said vertical axis of said tower, said rotational movement being on a horizontal plane parallel to the floor, said auxiliary telescoping vertical mechanism means for connecting an attachment for various accessories and providing vertical positioning of said accessories, said auxiliary telescoping vertical mechanism means for providing horizontal positioning of said accessories by pivoting about the common axis of said uprights, (c) said supplementary extension apparatus mechanism comprising a supplementary hook-shaped section and an supplementary extension support section, said supplementary hook-shaped section rotationally encircling said tower section of said base, said supplementary extension support section fixedly attached to a supplementary telescoping vertical mechanism, said supplementary telescoping vertical mechanism comprising an supplementary extension telescoping upright affixed telescopically to an supplementary telescoping upright with an adjusting mechanism, said supplementary hook-shaped extension section means for permitting unencumbered rotational movement of said supplementary extension apparatus mechanism to a multiplicity of positions by sliding rotationally around said vertical axis of said tower, said rotational movement being on a horizontal plane parallel to the floor, said supplementary telescoping vertical mechanism means for connecting an attachment for various accessories and providing vertical positioning of said accessories, said supplementary telescoping vertical mechanism means for providing horizontal positioning of said accessories by pivoting about the common axis of said uprights, (d) said spacers shaped to coincide with said outer concave surfaces and said points of said tower of said base and allowing room to pass over said vertical channel strips on said tower, said spacers each being a non-rotating bearing device for retaining means for a plurality of said extension apparatus mechanisms, said auxiliary extension apparatus mechanisms, and supplementary extension apparatus mechanisms, said spacers secured to said base between each of said apparatus mechanisms, said spacers means for permitting unencumbered independent rotation of each said hook-shaped extension section about said vertical axis of said base, whereby said auxiliary extension telescoping upright being an interacting telescoping member affixed telescopically with said adjustment mechanism means for a plurality of vertical and horizontal positioning orientations of said attachments or said accessories relative to said base, whereby said supplementary extension telescoping upright being an interacting telescoping member affixed telescopically with said adjustment mechanisms for a plurality of vertical and horizontal positioning orientations of said attachments or said accessories relative to said base, whereby each said extension apparatus mechanism means for providing support for said attachments and said accessories, and providing rotational adjustable of said attachments and said accessories around said base, being positional to in front of or to a multiplicity of positions beside said user, whereby said accessories being positional to beside a user with each of said horizontal adjustment mechanisms, whereby a fulcrum point being created at lowest end of said telescoping upright of auxiliary extension apparatus mechanism, which rests on a floor, whereby said adjustment mechanisms providing a plurality of positioning as to vertical orientation or pivotal orientation of said base to said attachments or said accessories, whereby the combination of said base, said auxiliary extension apparatus mechanism, said supplementary extension apparatus mechanism, and said spacers to be assembled for use on either the right or left side of said person in various standing, seated, reclining, or laying positions with all adjustments being made easily and fixed securely, and whereby the combination of said base, said auxiliary extension apparatus mechanism, said supplementary extension apparatus mechanism, and said spacers provide a freestanding usable storage area and convenient adjustable adaptable positional working, eating, or playing area that can be used alone, or can be located near a chair or a lounging surface for a person in various seated, reclining, or laying positions.

* * * * *

UNITED STATES PATENT AND TRADEMARK OFFICE

CERTIFICATE OF CORRECTION

PATENT NO. : 6,802,265 B1 
DATED : November 17, 2004
INVENTOR(S) : Robert L. Dodson and Carol A. Dodson It is certified that error appears in the above-identified patent and that said Letters Patent is hereby corrected as shown below:

Column 4,
Lines 24, "FIG. 2 is an isometric exploded view of the parts comprising the base, extension apparatus mechanism, entrapment ring, pockets, with two detailed views of cutaway portions of the entrapment ring." should read -- FIG. 2 is an isometric exploded view of the parts comprising the base, extension apparatus mechanism, entrapment ring and pockets.

FIG. 2a shows a sectional view of a portion of entrapment ring with holed tab, and bolt and nut.

Figure 2B:
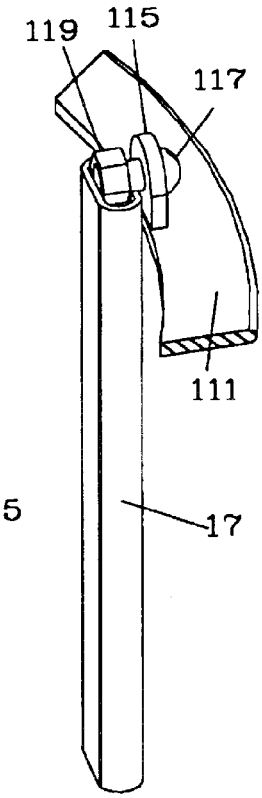

FIG. 2b shows a sectional view of a portion of the entrapment ring as it is connected to a vertical channel strip with bolt and nut. --

Line 29, "FIG. 4 is an exploded view of extension apparatus mechanism and the telescoping vertical mechanism of the table support assembly, is an assembly cutaway view of part of the telescoping vertical mechanism of the table support assembly." should read -- FIG. 4 is an exploded view of the extension apparatus mechanism and the telescoping vertical mechanism. --

FIG. 4A shows a sectional view of the screws, holes, and grooved indention of the non-rotating telescoping upright and the round upright.

FIG. 5 is an assembled cutaway view of part of the telescoping vertical mechanism of the table support assembly.

Line 40, "FIG. 9 is a view of the features of the clamshell, lever and guide of the table horizontal adjustment mechanism." should read -- FIG. 9 is an exploded view of the clamshell, with the lever, and guide of the table horizontal adjustment mechanism. --

Line 54, "FIG. 16 is an assembled view of the base, three different extension apparatus mechanisms, and the entrapment ring." should read -- FIG. 16 is an assembled view of the base, with three different extension apparatus mechanisms, and the entrapment ring. --

Line 60, "FIG. 19 is a view of handle assembly and wheel assembly" should read -- FIG. 19 is an assembled view of handle assembly and wheel assembly attached to base. --

Line 61, "FIG. 20 is an exploded view of handle assembly and wheel assembly" should read -- FIG. 20 is the base and an exploded view of handle assembly and wheel assembly. --

FIG. 18, FIG. 21 and FIG. 22, insert periods at the end of descriptions.

UNITED STATES PATENT AND TRADEMARK OFFICE

CERTIFICATE OF CORRECTION

PATENT NO. : 6,802,265 B1
DATED : November 17, 2004
INVENTOR(S) : Robert L. Dodson and Carol A. Dodson It is certified that error appears in the above-identified patent and that said Letters Patent is hereby corrected as shown below:

Column 8,
Line 13, "In FIG. 2, base 10 is comprised of a tower section 11, an entrapment ring 111, and an extended base section 110." should read -- In FIG. 2, base 10 is comprised of a tower section 11 with vertical channel strips 17 and an extended base section 110. --

Line 28, "An entrapment ring 111 is comprised of a circular piece with holed tabs 115 for receiving bolts 117 and nuts 119, as shown in Detail A." should read -- An entrapment ring 111 is comprised of a circular piece with holed tabs 115 for receiving bolts and nuts. --

Line 36, delete "The entrapment ring 111 is secured to the vertical channel strip 17 with bolts 117 and nuts 119. as shown in Detail B. Nuts 119 are placed inside strips 17, and securely tightened with bolts 117 after entrapment ring 111 is in position on tower section 11."

Line 54, before "In FIG. 3...", insert
-- In Fig. 2a, a portion of entrapment ring 111 with a holed tab 115 is shown close up, with receiving bolt 117 and nut 119 positioned in relation to holed tab 115.
In Fig. 2b, a portion of entrapment ring 111 is shown secured to the vertical channel strip 17 with bolts 117 and nuts 119. Nuts 119 are placed inside strips 17, and securely tightened with bolts 117 after entrapment ring 111 is in position on the tower section. --

Line 57, "In FIG. 4, telescoping vertical mechanism..." should read -- In exploded view FIG. 4, telescoping vertical mechanism...--

Line 64, "Clamping sleeve 25 has a latching mechanism 27 that when open will allow for insertion of upright 41 through clamping sleeve 25. An optional removable tip 49 is placed on the bottom of telescoping upright 41. The latching mechanism 27 is closed to secure upright 41. A fulcrum point is created between the base and the table as the upright 41, or tip 49 attached to upright 41, rests on the floor." should read -- Clamping sleeve 25 has a latching mechanism 27 that when open will allow for insertion of upright 41 through clamping sleeve 25. The latching mechanism 27 is closed to secure upright 41. An optional removable tip 49 is placed on the bottom of telescoping upright 41. A fulcrum point is created between the base and the table as the upright 41, or tip 49 attached to upright 41, rests on the floor. --

UNITED STATES PATENT AND TRADEMARK OFFICE

CERTIFICATE OF CORRECTION

PATENT NO. : 6,802,265 B1
DATED : November 17, 2004
INVENTOR(S) : Robert L. Dodson and Carol A. Dodson It is certified that error appears in the above-identified patent and that said Letters Patent is hereby corrected as shown below:

Column 9,
Line 13, "Screw 46 is affixed to upright 47 through hole 47a and lines up with a grooved indention 48 that encircles upright 45 to allow upright 47 to rotate around the common axis of uprights 45 and 47 for horizontal positioning." insert -- FIG. 4A is a sectional view of screws 44 and 46, holes 43a and 45a, and grooved indention 48 of the non-rotating telescoping upright and the round upright. The assembled partial view FIG. 5 shows uprights 43/45 placed through the vertical adjustment mechanism 140, which is affixed to the top of upright 41. Also shown in upright 43 are the telescoping holes 43b. Upright 47 is shown affixed to uprights 43/45 by screw 46 positioned through the hole in upright 47 and into the grooved indention of upright 45. Uprights 43/45 extend beyond the full height of upright 47. --

Line 18, "The sectional view FIG. 5 shows uprights 43/45 placed through the vertical adjustment mechanism 140 that is affixed to the top of upright 41 shown as a cut-away portion. Also shown..." should read -- The assembled partial view FIG. 5 shows uprights 43/45 placed through the vertical adjustment mechanism 140 which is affixed to the top of upright 41. Also shown... --

Line 63, "Support am 63 is comprised of a circular support segment 63a attached to a configured bar 63b." should read -- Table support/rotation arm 63 is comprised of a circular support segment 63a attached to a configured bar 63b.--

Column 10,
Line 3, "Shown in FIG. 8, is each clamp segment 6la and 61b of clamp 61. The wings 71a, 71b, 71c, 71d accommodate holes 73a, 73b, 73c, 73d for bolts 75 and nuts 77 to securely fasten clamp 61 to upright 47. A pintile 79 extends above wing 71a of clamp segment 61a of clamp 61. A pintile latching device 79a atop pintile 79 fits into the inside of a receiver 68a in the domed cover 68 is shown in the cut-away view." insert the following -- Hollow upright 47 is shown for reference of positioning to the clamp 61 and the domed cover 68. --

Column 11,
Line 3, "In the exploded view, the bar 63b of support arm 63 is positioned..." should read -- Bar 63b of support arm 63 is positioned... --

Line 7, "Domed cover 68 will fasten onto clamp 61 concealing clamshell 65, guide 67, and a portion of the lever short leg 69a." should read -- Domed cover 68 will fasten onto clamp 61 concealing clamshell 65, guide 67, and a portion of the lever short leg. --

Line 28, "Shown in FIG. 11 is the top of table 90 with table inserts 97a, 97b, 97c and 97d." should read -- Shown in exploded view FIG. 11 is the top of table 90 with table inserts 97a, 97b, 97c and 97d. --

UNITED STATES PATENT AND TRADEMARK OFFICE

CERTIFICATE OF CORRECTION

PATENT NO. : 6,802,265 B1
DATED : November 17, 2004
INVENTOR(S) : Robert L. Dodson and Carol A. Dodson It is certified that error appears in the above-identified patent and that said Letters Patent is hereby corrected as shown below:

Column 12,
Line 15, "FIG. 15 shows a portion of the underneath side of table 90 without the table support platform in place, with cam latching mechanism 92a and the nut 92g that is embedded into the recessed area 98a." should read -- FIG. 15 shows a portion of the underneath side of table 90 without the table support platform in place, cam latching mechanism 92a, and the nut 92g that is embedded into the recessed area 98a. --

Column 13,
Line 54, "FIG. 19 shows an assembled view exposing the underneath side of base 10 and handle assembly mechanism.." should read -- FIG. 19 shows an assembled view exposing the underneath side of base 10 and showing the handle assembly mechanism... --

Line 62, "Seen in FIG. 20, is an exploded view of the underneath side..." should read -- Seen in FIG. 20, is base 10 with tower 11 and a view of the underneath side... --

Column 14,
Line 1, "Handle assembly mechanism 150 and wheel assembly 130 are also shown in FIG. 20." should read -- Also shown in FIG. 20, are exploded views of handle assembly mechanism 150 and wheel assembly 130. --

Line 3, "The handle assembly mechanism 150 is comprised of a series of telescoping extensions 151 and 152, which is connected with hinge assembly mechanism 153 and linkage to connect to base 10." should read -- The handle assembly mechanism 150 is comprised of a series of telescoping extensions 151 and 152, which is connected with hinge assembly mechanism 153 and linkage 155 to connect to base 10. --

UNITED STATES PATENT AND TRADEMARK OFFICE

CERTIFICATE OF CORRECTION

PATENT NO. : 6,802,265 B1 
DATED : November 17, 2004
INVENTOR(S) : Robert L. Dodson and Carol A. Dodson It is certified that error appears in the above-identified patent and that said Letters Patent is hereby corrected as shown below:

Column 15,
Line 1, "Also shown in light phantom lines are accessories for..." should read -- Also shown in phantom are accessories for... --

Line 4, "A container is placed in the projection 16 of a pocket 15 on the base 10." should read -- A phantom container is placed in the projection 16 of a pocket 15 on the base 10. --

Line 50, "The hinge section 153a along with secured telescoping extensions 151 will rotate from a vertical position to a horizontal position that is parallel to the floor, and cam lever 153c is then returned to the locked position." insert -- Shown more clearly in Fig. 21A, are springs 153g, handle latching device 153f and shaft 153h. --

Line 62, "The auxiliary extension apparatus mechanism 220 is shown with an accessory of a light, shown in light phantom lines." should read -- The auxiliary extension apparatus mechanism 220 is shown with an accessory of a light, shown in phantom. --

Line 65, "The supplemental extension mechanism 320 is show with an accessory of a document holder, shown in light phantom lines." should read -- The supplemental extension mechanism 320 is show with an accessory of a document holder, shown in phantom. --

Signed and Sealed this

Fourteenth Day of June, 2005

JON W. DUDAS
*Director of the United States Patent and Trademark Office*